US007242397B2

(12) United States Patent
Iseki et al.

(10) Patent No.: US 7,242,397 B2
(45) Date of Patent: Jul. 10, 2007

(54) DISPLAY DEVICE

(75) Inventors: Masami Iseki, Kanagawa (JP); Somei Kawasaki, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 514 days.

(21) Appl. No.: 10/847,855

(22) Filed: May 19, 2004

(65) Prior Publication Data

US 2005/0007359 A1 Jan. 13, 2005

(30) Foreign Application Priority Data

May 21, 2003 (JP) ..... 2003-142910
May 18, 2004 (JP) ..... 2004-147603

(51) Int. Cl.
*G09G 5/00* (2006.01)

(52) U.S. Cl. ..... 345/204; 345/99

(58) Field of Classification Search ..... 345/87, 345/88, 89, 90–100, 204
See application file for complete search history.

(56) References Cited

U.S. PATENT DOCUMENTS

2003/0137482 A1* 7/2003 Tanaka et al. ..... 345/100
2005/0179628 A1* 8/2005 Kimura ..... 345/77

FOREIGN PATENT DOCUMENTS

JP 8-146919 6/1996

* cited by examiner

*Primary Examiner*—Nitin I. Patel
(74) *Attorney, Agent, or Firm*—Fitzpatrick, Cella, Harper & Scinto

(57) ABSTRACT

A display device for displaying images based on video signals includes a timing signal generating circuit for generating a timing signal, a sampling signal generating circuit for generating a sampling signal at the timing corresponding to the timing signal, and a sampling circuit for sampling a target signal during a sampling period set by the sampling signal and outputting the sampled target signal. The sampling circuit is connected to the timing signal generating circuit so that test output obtained by sampling a test target signal during the sampling period set by the sampling signal corresponding to a test timing signal generated by the timing signal generating circuit can be input into the timing signal generating circuit, and the timing signal generating circuit controls the relative output timing between the timing signal and the target signal under the control based on the test output input.

11 Claims, 16 Drawing Sheets

DISPLAY DEVICE

BACKGROUND OF THE INVENTION

1. Field of the Invention

The present invention relates to the technology of sampling signals from sampled target signals using sampling signals. Display devices may be taken as a specific example to which this technology can be applied.

2. Related Background Art

The technology of sampling signals from sampled target signals using sampling signals is known. For example, in the field of display panel devices for displaying images, the technology of sampling signals corresponding to a specific pixel from video signals as sampled target signals is known.

Upon sampling, exact sampling cannot be performed unless a sampling signal for determining the timing of sampling a signal from sampled target signals must be transmitted in a certain timing relation to the sampled target signal. The technology of adjusting the timing of the sampling signal is known so that exact sampling can be performed.

Japanese patent Application Laid-Open No. H08-146919 discloses a technique for automatically determining the optimum timing of a horizontal clock signal by feeding one of created horizontal sampling signals back to a clock phase controller to determine a phase lag between the horizontal clock signal and the horizontal sampling signal as a propagation delay of a horizontal sampling signal generating circuit and a delay time of the signals traveling between timing signal generating means and an EL panel.

SUMMARY OF THE INVENTION

The present application is to provide a novel technique capable of setting the relative output timing between a sampling signal and a sampled target signal as appropriate.

According to one invention of the present application, there is provided a display panel device for displaying images based on video signals, comprising:

a timing signal generating circuit for generating a timing signal;

a sampling signal generating circuit for generating a sampling signal at the timing corresponding to the timing signal; and a sampling circuit for sampling a target signal during a sampling period set by the sampling signal and outputting the sampled target signal, wherein the sampling circuit is connected to the timing signal generating circuit so that test output obtained by sampling a test target signal during the sampling period set by the sampling signal corresponding to a test timing signal generated by the timing signal generating circuit can be input into the timing signal generating circuit, and the timing signal generating circuit controls the relative output timing between the timing signal and the target signal under the control based on the test output input.

According to this invention, it is preferable to adopt such a structure that the relative output timing between the timing signal and the target signal is controlled based on the maximum value of test outputs corresponding to multiple test timing signals having different output timings.

It is also preferable to adopt such a structure that the relative output timing between the timing signal and the target signal is controlled based on the differential value of test outputs corresponding to multiple test timing signals having different output timings.

It is further preferable to adopt such a structure that the relative output timing between the timing signal and the target signal is controlled based on the second-order differential value of test outputs corresponding to multiple test timing signals having different output timings.

Further, according to any of the above-mentioned inventions, it is preferable to adopt such a structure that the test timing signal is generated from the timing signal generating circuit during a period for which no video signal is programmed in pixel that form an image display part for displaying images to determine the relative output timing between the timing signal and the target signal. Preferably, the test timing signal is generated from the timing signal generating circuit during a power-on or standby time or a vertical blanking period to determine the relative output timing between the timing signal and the target signal.

Furthermore, according to any of the above-mentioned inventions, it is preferable to adopt such a structure that the output of the sampling circuit is a current signal. It is also preferable to adopt such a structure that the output of the sampling circuit is a voltage signal, and the relative output timing between the timing signal and the target signal is determined based on test output of the sampling circuit through a level converting circuit.

The present application also includes the following invention:

A signal generating circuit comprising:

a timing signal generating circuit for generating a timing signal by which the timing of generating a sampling signal is determined;

a target signal output circuit for outputting a target signal to be sampled; and an adjustment circuit for adjusting the relative output timing between the timing signal and the target signal, wherein the adjustment circuit adjusts the relative output timing between the timing signal and the target signal based on plural sampling results obtained from plural states in each of which the relative output timing between a test timing signal and a test target signal is made different from those in the other states.

The present invention also includes a display panel, comprising:

a plurality of display elements;

a plurality of first sampling signal generating circuits which sequentially generate a plurality of first sampling signals for sequentially sampling a target signal;

a plurality of first sampling circuits for sequentially sampling a target signal during the sampling periods set by the first sampling signals;

a plurality of wires between the output of the first sampling circuits and the pixels;

a second sampling signal generating circuit which generates a second sampling signal for sampling a target signal;

a second sampling circuit for sampling a target signal during sampling period set by the second sampling signal; and a wire for outputting the output of the second sampling circuit to external of the display panel without passing through the display elements.

BRIEF DESCRIPTION OF THE DRAWINGS

FIG. 17A is a circuit diagram showing an example of the voltage-current converting circuit. FIG. 17B is a graph for explaining the voltage-current conversion characteristic of FIG. 17A. FIG. 17C is a circuit diagram showing another example of the voltage-current converting circuit. FIG. 7D is a graph for explaining the voltage-current conversion characteristic of FIG. 17C.

DESCRIPTION OF THE PREFERRED EMBODIMENTS

The present application relates to sampling technology capable of being adopted in various preferred embodiments. Particularly, it can be used as appropriate as a structure for sampling video signals in a display panel device for displaying images.

A display panel device using electroluminescence elements (called EL elements) as a display elements or a display panel device using liquid crystal elements as a display elements can be employed as the display panel device.

The following takes display panel devices using EL elements by way of example to describe preferred embodiments according to the present application.

Figure 18:
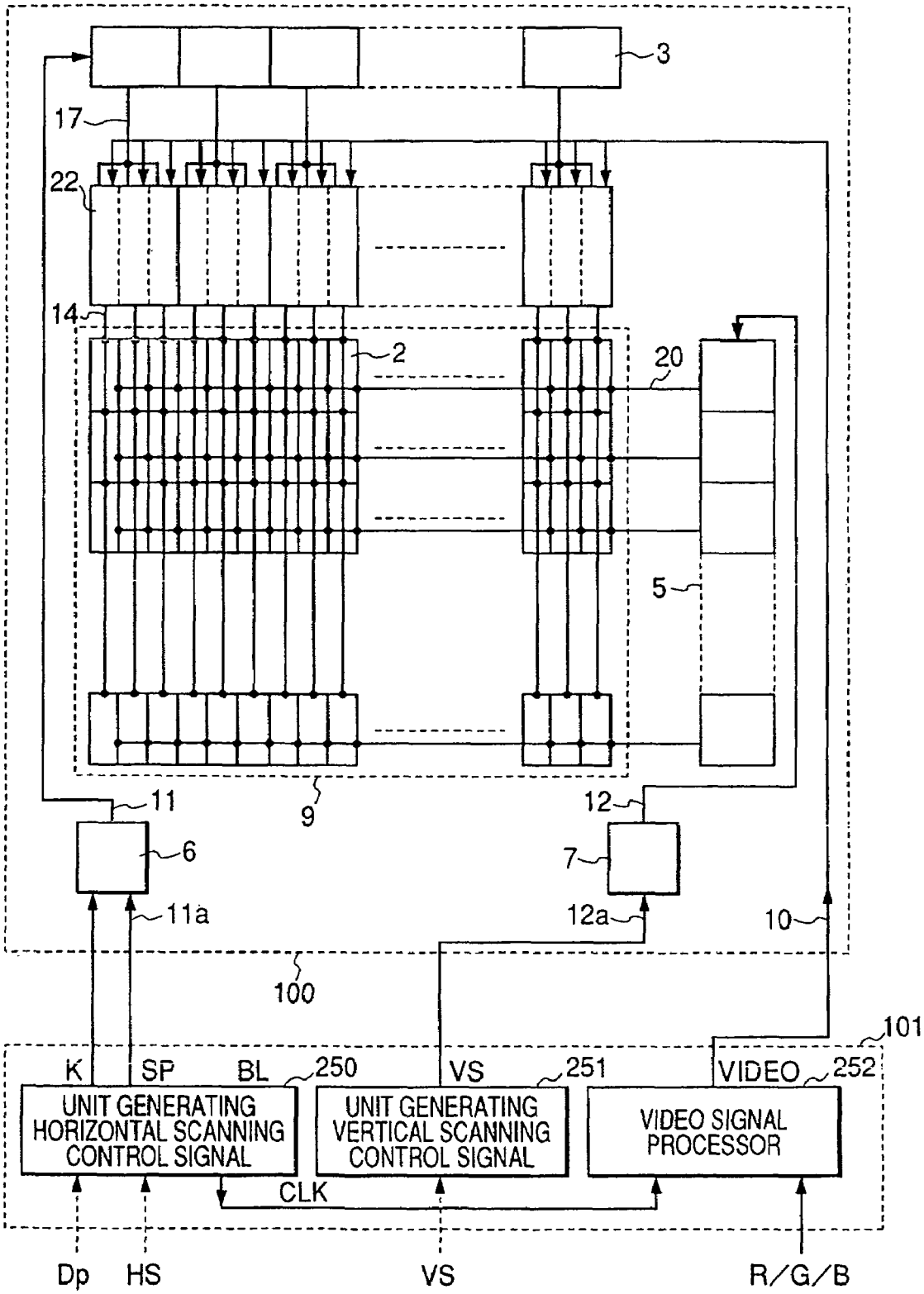
FIG. 18 is a schematic diagram showing the general circuit structure of a display panel device of a voltage setting type.

An example of the basic structure of the preferred embodiments is shown in FIG. 18. A glass substrate can be used as appropriate as a substrate 100 that forms a display panel. On the glass substrate 100, TFT devices of amorphous silicon or polysilicon are provided, including EL pixel circuits 2, shift registers 3 as sampling signal generating circuits, column control circuits 22 as sampling circuits for sampling video signals based on sampling signals output from the respective shift registers 3, vertical shift registers 5 as vertically operating circuits, an input circuit 6 as a level converting circuit, and an input circuit 7 as another level converting circuit.

On the other hand, on a signal processing board 101 connected to the display panel, CMOS devices of single crystal silicon are provided, including a unit 250 generating horizontal scanning control signals and a unit 251 generating vertical scanning control signals as timing signal generating circuits, and a video signal processor 252.

The input circuits 6 and 7 mentioned above are circuits for converting the level of each signal input from the signal processing board 101 into the operating level of the TFT devices on the display panel.

There are known voltage setting and current setting types of EL display panels. The following describes the structures of both types, respectively.

<Voltage Setting Type Display Panel Device>

EL elements are applied to a panel type image display system (hereinafter called the display panel device) in which the pixel circuits 2, each formed of thin film transistors (TFT), are arranged in a two-dimensional array. One of methods of setting the emission of the EL elements in such a display panel device is a voltage setting method. FIG. 18 shows the circuit arrangement of the display panel device in which a color display is made possible by the voltage setting method.

RGB video signals VR, VG, and VB, a vertical sync signal VS, a horizontal sync signal HS, and phase setting data Dp are input from the outside into the display panel device. The video signal processor 252 performs signal processing on VR, VG, and VB such as gamma correction so that images will be properly shown on the display panel device, and outputs the processed signals as video (RGB) signals. The horizontal sync signal HS is input into the unit 250 generating horizontal scanning control signals. The unit 250 generating horizontal scanning control signal reproduces a clock signal CLK from the input horizontal sync signal HS using a PLL circuit or the like, and generates a horizontal clock signal K, a blanking signal BL, and a horizontal scanning start signal SP. The unit 250 generating horizontal scanning control signals also sets the phase of the horizontal clock signal K and the phase of the horizontal scanning start signal SP based on the value of the input phase setting data Dp so that the sampling of video signals "video" can be done in the EL panel part at the best suitable or optimum timing. The vertical sync signal VS is input into the unit 251 generating vertical scanning control signals. The vertical sync signal VS and the reproduced clock signal CLK are input into the unit 251 generating vertical scanning control signals, so that the unit 251 generating vertical scanning control signals generates a vertical scanning start signal LS.

In the EL panel part, the input RGB image information 10 is conveniently input into the column control circuits 22, each set of which includes three circuits for RGB colors, that is, the number of which is three times the number of horizontal pixels. A horizontal control signal 11*a* is input into the input circuit 6, and output as a horizontal control signal 11. The horizontal control signal is then input into the horizontal shift registers 3 the number of which is equal to the number of horizontal pixels. This horizontal control signal 11 consists of the horizontal clock signal and the horizontal scanning start signal. A horizontal sampling signal group 17 output from respective terminals of the horizontal shift registers 3 are input into the column control circuits 22 assigned to the respective shift registers 3.

(Column Control Circuit)

Figure 20:
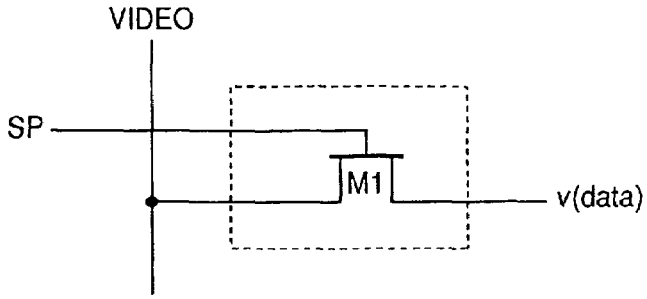
FIG. 20 is a circuit diagram of a column control circuit of the voltage setting type.

As shown in FIG. 20, each of the column control circuits 22 has such a simple structure that the sampling signal SP is coupled to M1/G, the input video signal "video" (one of RGB) is coupled to M1/S, and image voltage data V(data) as a column control signal 14 is output to M1/D. In this specification, the gate, source, and drain electrodes of each transistor are represented in abbreviated form as /G, /S, and /D, respectively, for convenience' sake. Further, the terms signal and signal line supplying the signal may be represented interchangeably.

An image display part 9 is formed of pixel circuits 2 having the same structure and arranged in a two-dimensional array. Each of the pixel circuits 2 serves to drive one of RGB EL display elements, and a set of three pixel circuits 2 handle the display of one pixel. The image voltage data V(data) is input into a group of pixel circuits 2 arranged in the same column.

A vertical control signal 12*a* outputs a vertical control signal 12 through the input circuit 7. The vertical control signal 12 is input into the vertical shift registers 5 containing registers the number of which is equal to the number of vertical pixels. The vertical control signal 12 includes the vertical clock signal and the vertical scanning start signal. A row control signal 20 is input from each output terminal of the vertical shift registers 5 to the pixel circuits 2 arranged in the same row.

(Voltage Setting Type Pixel Circuit)

Figure 19:
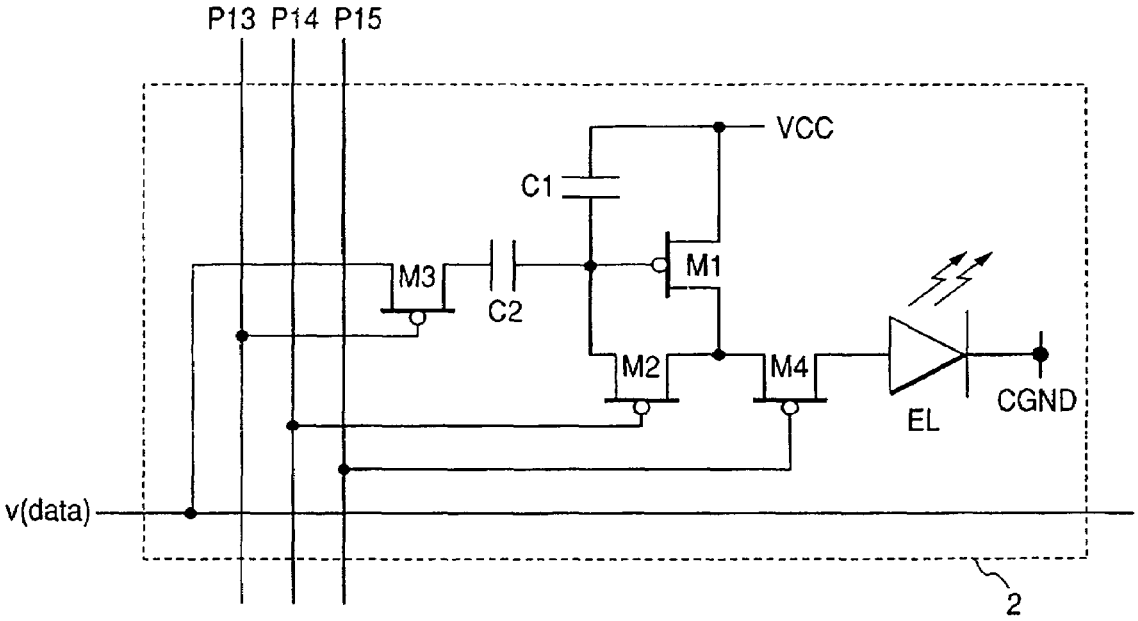
FIG. 19 is a circuit diagram of a pixel circuit of the voltage setting type.

FIG. 19 shows the structure of the voltage setting type pixel circuit 2. The voltage data V(data) is coupled to M3/S. The row control signals 20 are P13, P14, and P15, which are connected to M3/G, M2/G, and M4/G, respectively. M3/D is connected to capacitance C2, and the capacitance C2 is connected with M1/G and capacitance C1 with its source connected to the power supply VCC. M1/D and M1/G are connected to M2/D and M2/S, respectively. M1/D is also connected to M4/S, and M4/D is connected to the current injection terminal of an EL element with one end connected to ground.

Figure 21:
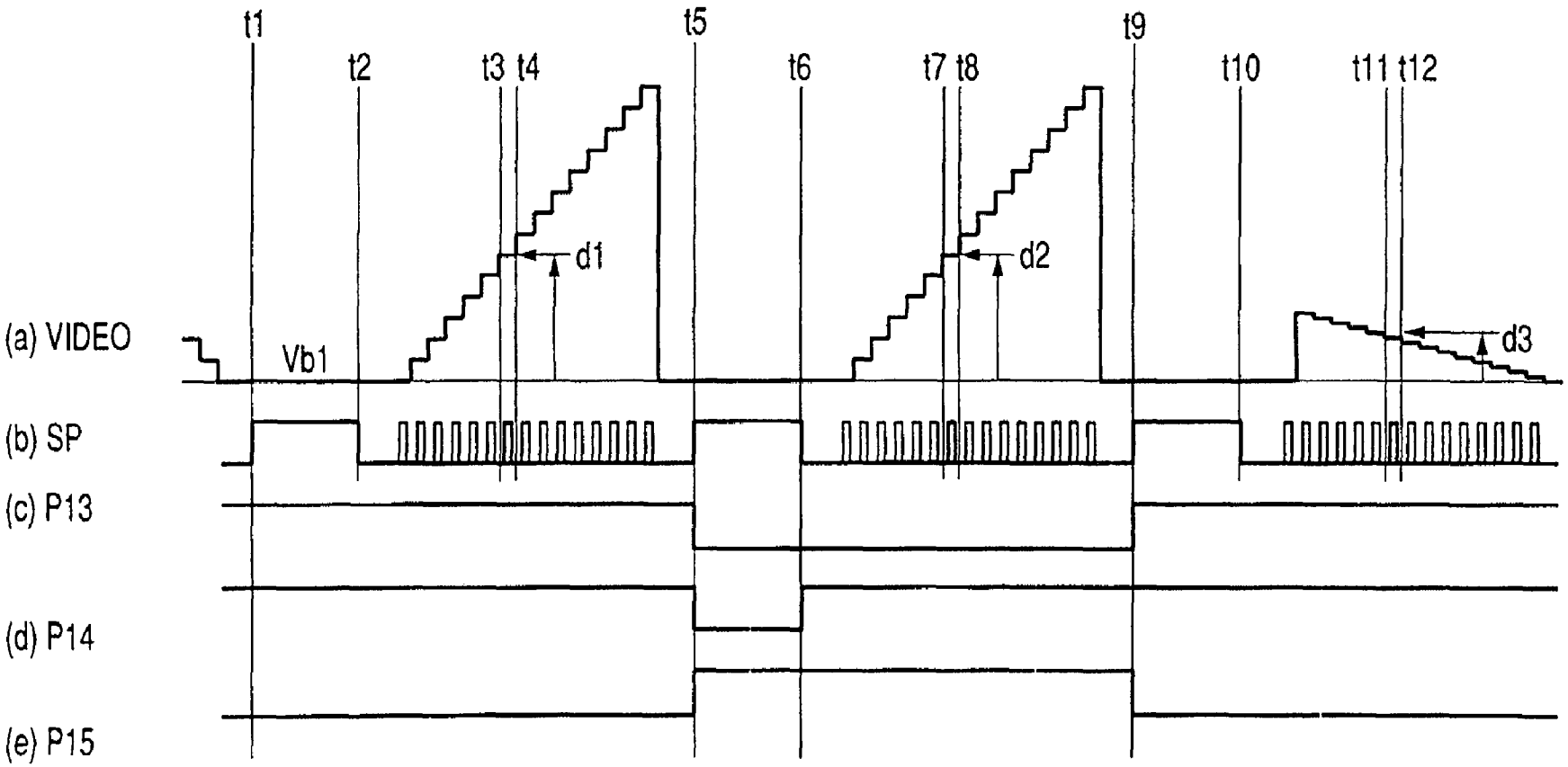
FIG. 21 is a timing chart for explaining the operation of the display panel device of FIG. 18.

The operation of the display panel device of FIG. 18 will next be described using a timing chart of FIG. 21. In FIG. 21, (a) indicates an input video signal "video," (b) a horizontal sampling signal SP, and (c) to (e) row control signals P13 to P15 in the rows concerned. FIG. 21 shows three horizontal periods, that is, three row periods.

The horizontal sampling pulses SP all change to H level over an interval from time t1 to time t2 within a horizontal blanking period of the input video signal. At this time, blanking voltage as the input video signal is set as the column control signal 14. Here, the horizontal sampling signal in the column concerned is indicated by a bold line.

Before Time t5 (Light Emission Holding Time)

The row control signals P13 to P15 to the pixel circuits 2 in the rows concerned are at H level, H level, and L level, respectively, over an interval from time t1 to time t5. Since M2, M3, and M4 of the pixel circuit 2 concerned remain turned OFF, OFF, and ON, respectively, even after the horizontal sampling pulses SP have all changed to H level, drain current of M1 determined by M1/G voltage across the pixel circuit 2 as voltage held in the capacitance C1 and the gate capacitance M1 is injected into the EL element concerned to let the El element emit light continuously. As shown in FIG. 21, the voltage of the input video signal "video" is voltage Vb1 close to the black level over the interval from time t1 to time t2.

Time t5 to time t9 (light emission setting period)

At time t5, the row control signals P13 and P15 in the rows concerned change to L level and H level, respectively. Then, the horizontal sampling pulses SP all change to H level again over an interval from time t5 to time t6. At this time, the blanking voltage as the input video signal is set as the column control signal 14.

In this case, in the pixel circuits 2 in the rows concerned shown in FIG. 19, M4 is turned off to stop supplying current to the EL element concerned and turn the EL element off. Further, since M2 and M3 are both ON-state, the capacitances C1 and C2, and the gate capacitance of M1 discharge so that (VCC-M1/G) voltage gradually become close to the threshold voltage Vth of M1, thereby resetting the drain current of M1 to a very small value. As shown in FIG. 21, the voltage of the input video signal "video" is also voltage Vb1 close to the black level over the interval from time t5 to time t6.

At time t6, although SP and P14 change to L level and H level, respectively, (VCC-M1/G) voltage across the pixel circuit 2 concerned are kept at the threshold voltage Vth.

Then, SP in the column concerned goes to H level over an interval from time t7 to time t8, an input video signal d2 at this time is input into the pixel circuit 2 concerned as V(data). At this time, the M1/G voltage of the pixel circuit 2 changes by a voltage ΔV. The voltage ΔV is substantially shown in the following equation 1).

$$\Delta V = d2 \times C2/(C2+C1+C(M1)) \quad 1)$$

C(M1) expresses the gate input capacitance of M1 in the pixel circuit 2 concerned. Then, at time t8, SP changes to L level again to keep the change in M1/G voltage shown in the equation 1) and remain unchanged until time t9.

After time t9 (light emission holding period)

At time t9, P13 and P15 change to H level and L level again, and M3 and M4 of the pixel circuit 2 concerned are turned OFF and ON, respectively. This causes the drain current determined by M1/G voltage across the pixel circuit concerned to be injected into the EL element concerned, changing the amount of light emission and maintaining this state.

Although the SP signal changes to H level over intervals from time t9 and t10 and time 11 to time 12, since M3 of the pixel circuit 2 is OFF-state, such changes do not affect the light emission of the EL element.

The equation 1) denotes that the amount of light emission can be set by a voltage value relative to Vb1 during the horizontal blanking period of the input video signal "video." The drain current Id of M1 in the pixel circuit 2 can be substantially shown in the following equation 2).

$$Id = \beta \times \Delta V2 \quad 2)$$

The EL element emits light essentially proportional to the injection current. Therefore, in the voltage setting type display panel device shown in FIG. 18, the amount of light emission from the EL element of each pixel can be controlled by a value proportional to the square of the input video signal level relative to the blanking voltage. For the voltage setting type display panel device, any time-proven circuit structure of liquid crystal panels can be used except for that of the pixel circuit 2.

(Unit Varying Horizontal Clock Phases)

Figure 8:
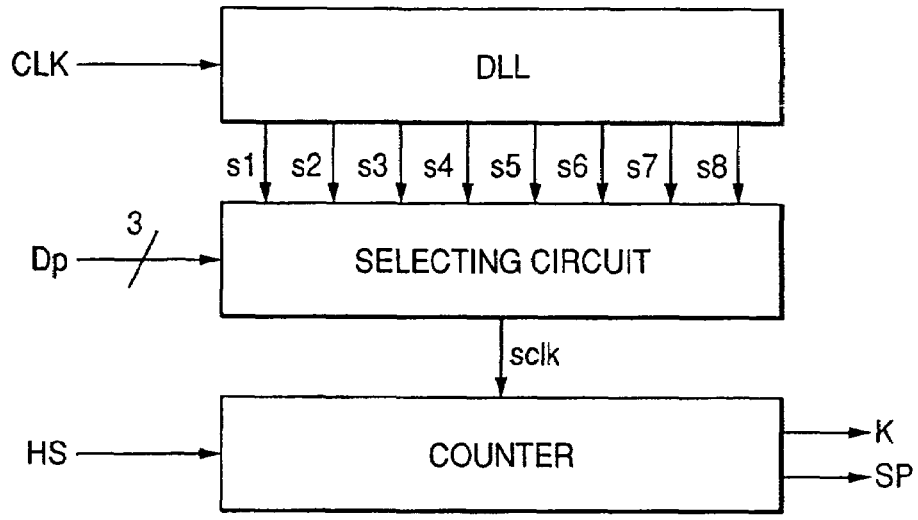
FIG. 8 is a block diagram showing an example of a unit varying clock phases.

FIG. 8 shows an example of a unit varying horizontal clock phase, as an adjustment circuit contained in the unit generating horizontal scanning control signals, for adjusting the phase of a clock signal to control the timing of a sampling signal. FIG. 8 shows a case where the phase can be varied with an accuracy of one-eighth the clock signal CLK cycle.

The reproduced clock signal CLK is input into a DLL part. Eight variable delay circuits are connected to the DLL part. The variable delay circuits dly1 to dly8 have the same structure with the same delay amount. Further, the output phase of dly8 and the phase of the DLL input clock signal CLK are controlled to match each other, so that the amount of delay in dly1 to dly8 becomes one-eighth the clock signal CLK cycle. The DLL outputs a group of delay clock signals s1 to s8 as outputs of the variable delay circuit group dly1–dly8. The delay clock signal group s1–s8 is routed to a selecting circuit in which one clock signal is selected from among the delay clock signal group s1–s8 according to the input phase setting data Dp. Then a certain time period sclk from the input of the horizontal sync signal HS until the video signal "video" becomes valid is determined to output a horizontal clock signal K and the horizontal scanning start signal SP at the timing shown in FIG. 9. As will be described in detail later, this adjustment is made in the embodiment so that the timing of the horizontal clock signal K will be controlled based on the sampling result of a test video signal according to a test timing signal. Although the above describes that the timing of the sampling signal is adjusted by adjusting the timing signal (clock signal) that determines the timing, the output timing of the video signal as a sampled target signal may be adjusted to adjust the relative timing between the sampling signal and the sampled target signal.

Figure 10:
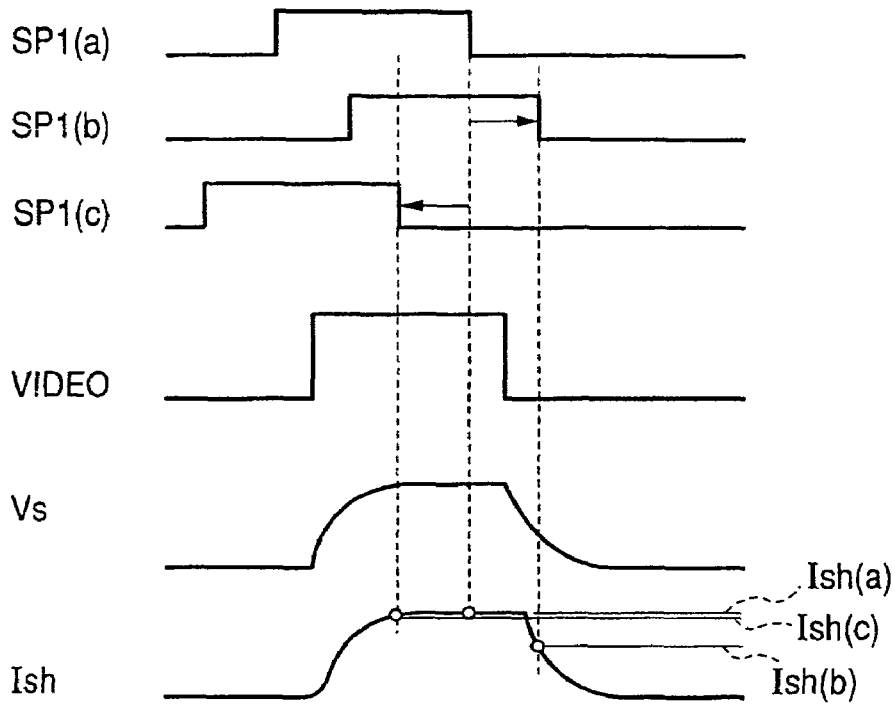
FIG. 10 is a timing chart for explaining the relationship between a video signal and horizontal sampling.

FIG. 10 shows the timing of a sampling video signal "video" using a sampling signal SPn in the EL panel part. Sampling waveform Ish denotes the current that drives EL as a result of sampling. The sampling signal SPn is created by the shift registers from the horizontal scanning start signal SP and the horizontal clock signal K. The relationship between the n-th video signal "video" and the sampling signal SPn requires that the video signal upon completion of the n-th sampling (when SPn changes from "H" to "L") is the n-th image information, and sufficient sampling time is provided from when the n-th video signial has changed until the n-th sampling is completed to allow for the sampling capacity.

In FIG. 10, sampling signal SP1(a) and the video signal "video" are in good condition in terms of the video signal upon completion of the sampling cycle and the sampling time. However, since the sampling signal SPn is created by the TFT shift registers in the EL panel part from the horizontal scanning start signal SP and the horizontal clock signal K, the phase of the sampling signal SPn is delayed from the phase of the horizontal clock signal K due to a propagation delay in the circuit. The sampling signal SP1(b) indicates a case where the sampling signal SPn is delayed due to the propagation delay. The relationship between the sampling signal SP1(b) and the video signal "video" shows that sampling cannot be performed normally because the video signal ends up in the (n+1)-th state upon completion of the n-th sampling. In the case of sampling signal SP1(c), the sampling signal SPn is progressing compared to the video signal "video." In this case, the relationship between the sampling signal SP1(c) and the video signal "video" also shows that sampling cannot be performed normally because the time interval from the time point when the n-th image information changed until the completion of the sampling is shorter than the required sampling time, thereby making the sampling event incomplete. For these reasons, the relative output timing between the sampling signal and the sampled target signal need to be adjusted in a manner described later.

<Current Setting Type EL Panel>

Figure 3:
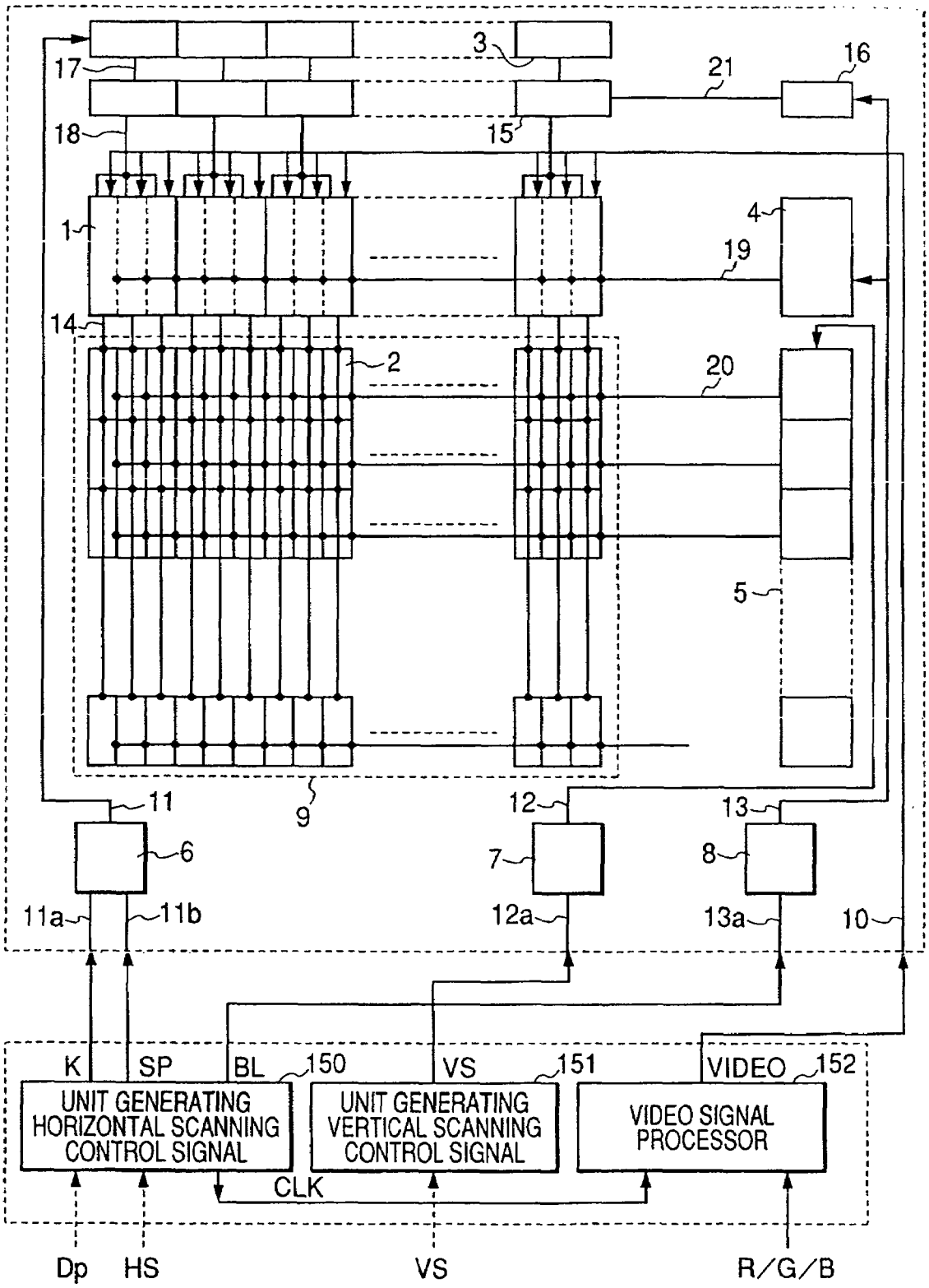
FIG. 3 is a block diagram of the general circuit structure of a display panel device of a current setting type.

Another method of setting the emission of the EL elements in the display panel device is a current setting method. FIG. 3 shows the circuit arrangement of the display panel device in which a color display is made possible by the current setting method. The following describes only the different portions from the voltage setting type display panel device of FIG. 18.

An auxiliary column control signal 13*a* outputs an auxiliary column control signal 13 through an input circuit 8. The auxiliary column control signal 13 is input into gate circuits 4 and 16. The horizontal sampling signal group 17 output from respective terminals of horizontal shift registers 8 are input into gate circuits 15, and converted horizontal sampling signal group 18 is input into column control circuits 1. A control signal 21 is also input into the gate circuits 15 from the gate circuit 16. On the other hand, a control signal 19 output from the gate circuit 4 is input into the column control circuits 1.

(Column Control Circuit)

Figure 15:
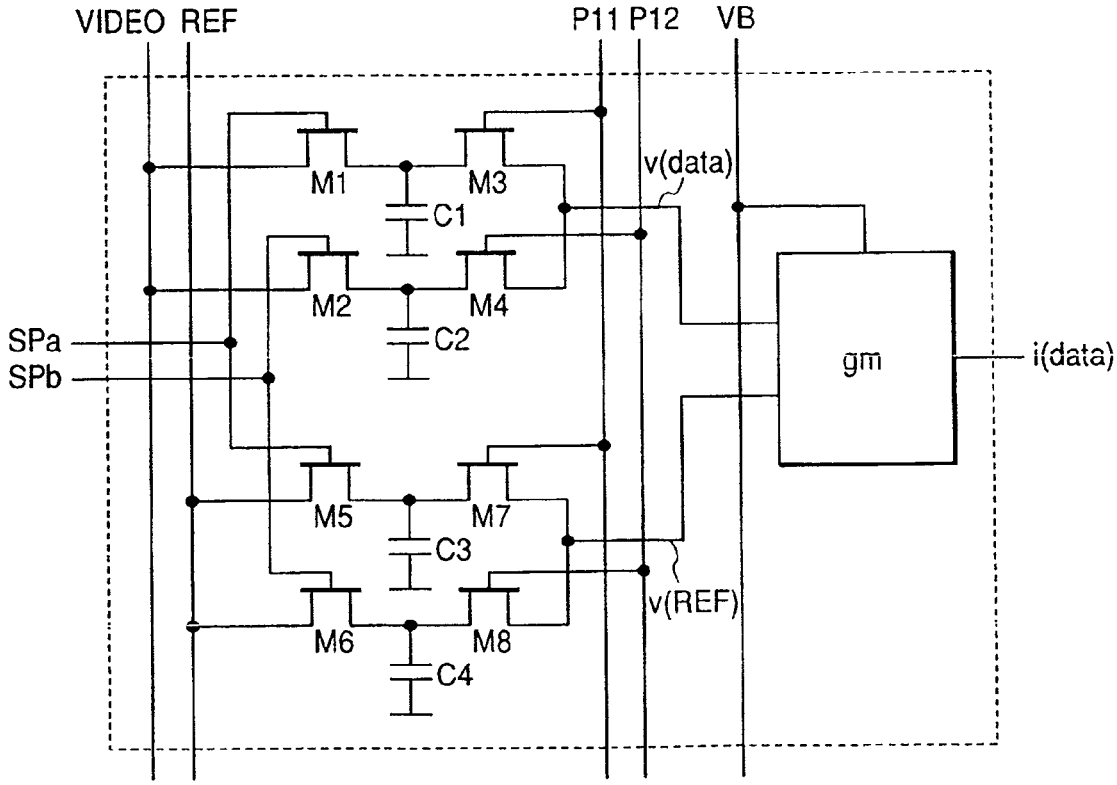
FIG. 15 is a circuit diagram showing an example of an EL element driving control circuit (column control circuit) of the current setting type.

FIG. 15 shows the structure of each of the column control circuits 1 arranged as sampling circuits the number of which is equal to the number of horizontal pixels in the current setting type display panel device. Input image information includes a video signal "video" and a reference signal REF, and is input into M1/S, M2/S, and M5/S, M6/S, respectively. The horizontal sampling signal group 18 output from the gate circuits 15 consists of SPa and SPb, respectively, and is coupled with M1/G, M5/G, and M2/G, M6/G in the column circuit 1. Capacitances C1, C2, C3, and C4 are connected to M1/D, M2/D, M5/D, and M6/D, and to M3/S, M4/S, M7/S, and M8/S, respectively. The control signals 19 are P11 and P12, which are connected to M3/G, M7/G, and M8/G, respectively. M3/D and M4/D, and M7/D and M8/D are connected to each other, and input as V(data) and V(REF) into a voltage-current converting circuit gm. A reference current setting bias VB is also input into the voltage-current converting circuit gm from which current data i(data) for use as the column control signal is output.

Figure 17C:
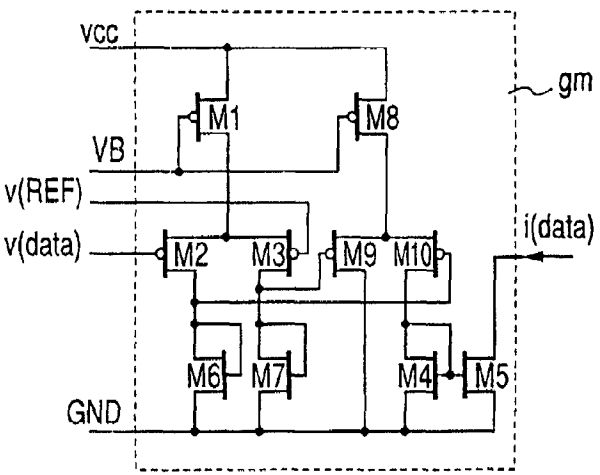
FIGS. 17A, 17B, 17C, and 17D are circuit diagrams showing examples of a voltage-current converting circuit used in FIG. 15 and graphs for explaining their voltage-current conversion characteristics.
Figure 17D:
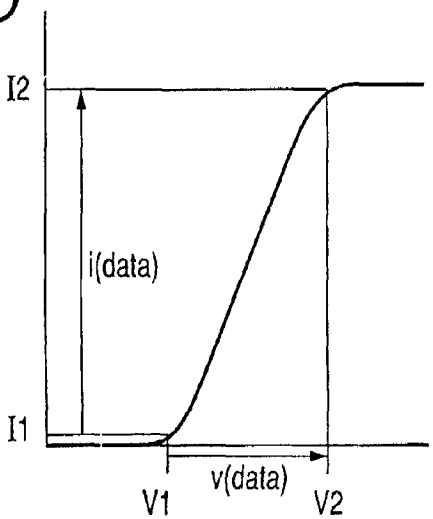
Figure 17A:
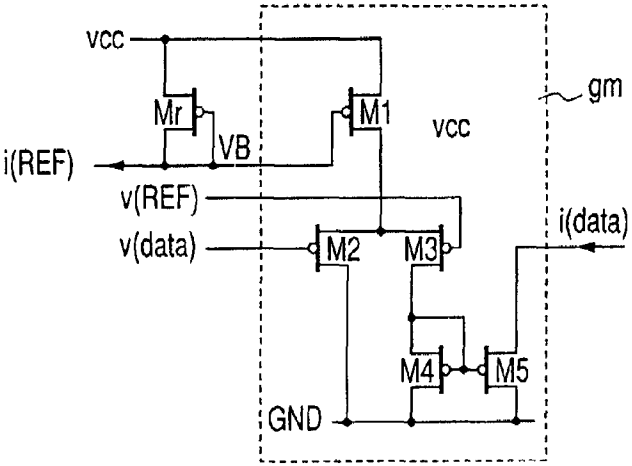

FIG. 17A shows an example of the structure of the voltage current converting circuit gm. Since the basic operating principles of the circuit are common, their description will be omitted, but the important point to note for power savings is that, for example, in the case of a 200 ppi-display panel device, the injection current to the EL element of each pixel is assumed small, about 100 nA at the maximum, well below 1 μA. Under this condition, in order to obtain as linear a voltage-current conversion characteristic as possible, it is necessary to reduce the W/L ratio in each gate region of M2 and M3, and hence keep the current drive capacity low.

Figure 17B:
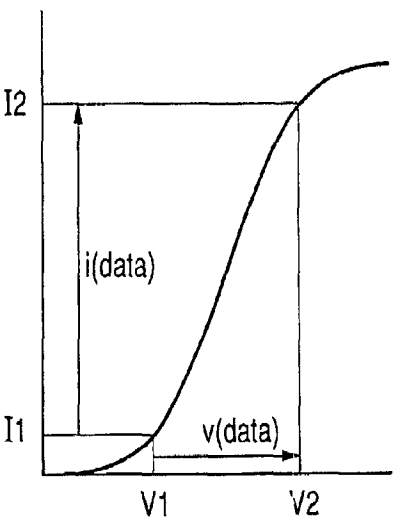

FIG. 17B shows the voltage-current conversion characteristic of FIG. 17A. It is difficult to design the voltage-current converting circuit gm of FIG. 17A in such a way as to set the minimum current I1 (black current) at the minimum voltage V1 (black level) to zero. If the black current I1 cannot be set as zero current, it will be impossible to provide contrasts important for the display panel device.

FIG. 17C shows an example of the structure of the voltage-current converting circuit gm that provides means to cope with the above-mentioned point. In this structure, M6 and M7, whose sources are connected to ground, and drains and gates are short-circuited, are connected to the drain terminals of source-coupled circuits M2 and M3, respectively. M8 is also provided in which the source is connected to the power supply and the gate operates as a second reference current source coupled to the reference current bias VB. Further, second source-coupled circuits M9 and M10 are provided and connected to M8/D. Then M9/G and M10/G are connected to M7/D and M6/D, respectively. Like in the voltage-current converting circuit gm in FIG. 17A, current data i(data) as the column control signal 14 is output from M10/D through a current mirror circuit formed of M4 and M5. In FIG. 17C, in order to keep the current driving capacity of M6 and M7 lower than that of M9 and M10, the W/L ratio in each gate region of M6 and M7 is made smaller than that of each gate region of M9 and M10. FIG. 17D shows the voltage-current conversion characteristic of the voltage-current converting circuit gm thus designed as shown in FIG. 17C. This structure makes it possible to reduce the black current I1 at the black level V1 without affecting the linearity of the voltage-current converting characteristic.

Figure 16:
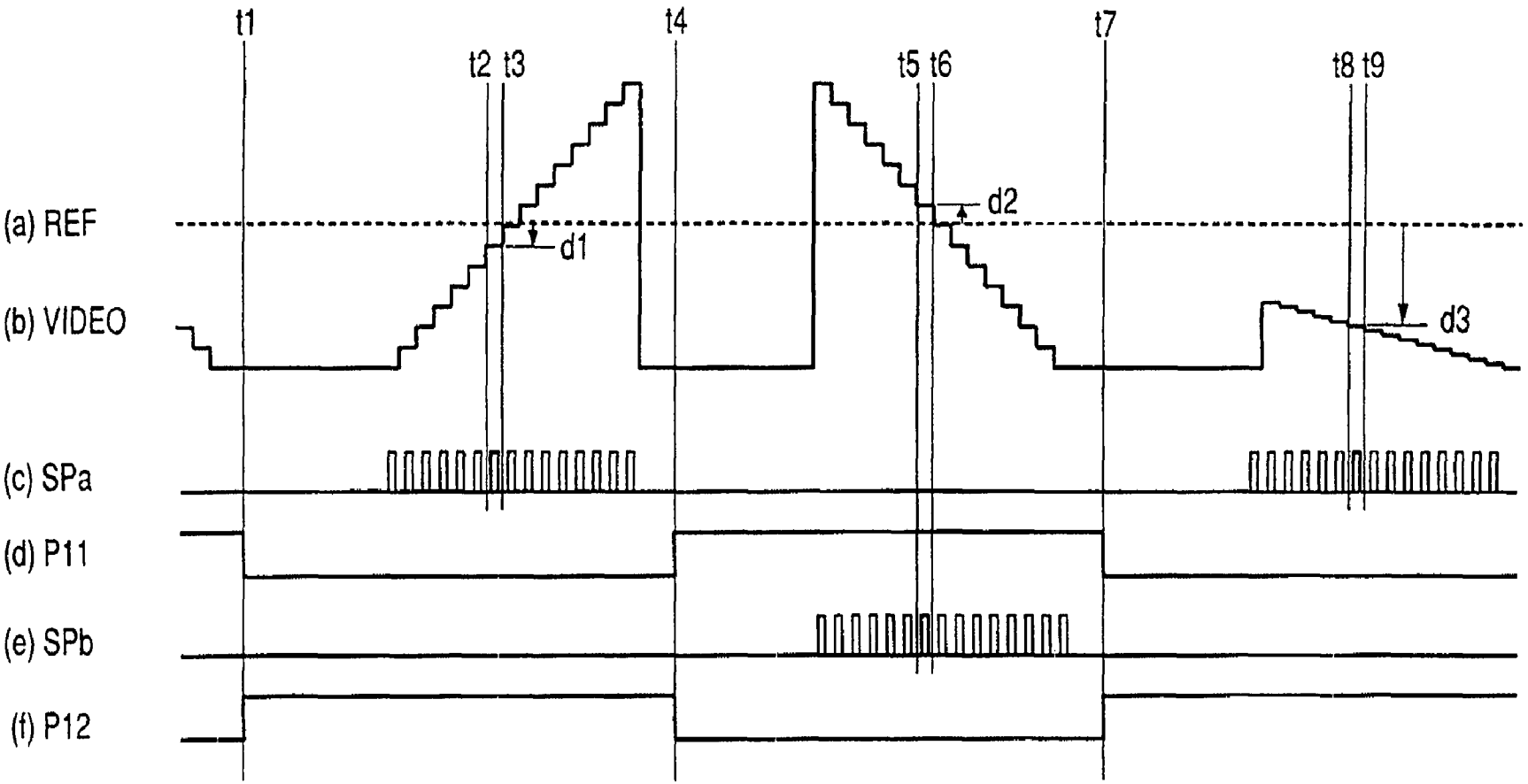
FIG. 16 is a timing chart for explaining the operation of FIG. 15.

The operation of the column control circuit will be described using a timing chart of FIG. 16. At time t1, the control signals P11 and P12 change to L level and H level, respectively. A horizontal sampling signal group SPa is generated during the valid period of the input video signal from time t1 to time t2. SPa for the column concerned is generated over an interval from time t2 to time t3, and Video and REF at this time are sampled and held in C1 and C3 after time 3. Then, at time t4, the control signals P11 and P12 change to H level and L level, respectively, so that (v(data)−v(REF)) to be input to the voltage-current converting circuit gm becomes d1, and the current data i(data) is output as the column control signal 14 over an interval from time t4 to time t7 based on the image information captured during the interval from time t2 to time t3.

On the other hand, a horizontal sampling signal group SPb is generated during the valid period of the input video signal from time t4 to time t7. SPb for the column concerned is generated over an interval from time t5 to time t6, and Video and REF at this time are sampled and held in C2 and C4 after time 6. Then, at time t7, the control signals P11 and P12 change again to L level and H level, respectively, so that (v(data)−v(REF)) to be input to the voltage-current converting circuit gm becomes d2, and the current data i(data) is output as the column control signal 14 for one horizontal scanning period from time t7 based on the image information captured during the interval from time t5 to time t6.

On the other hand, the horizontal sampling signal group SPa is generated again during the valid period of the input video signal in one horizontal scanning period from time t7. SPa for the column concerned is generated over an interval from time t8 to time t9, and Video and REF at this time are sampled and held in C2 and C4 after time 9. Such a sequence of operations is repeated so that the current data i(data) as the column control signal 14 is converted to a line-by-line sequential signal to be updated every horizontal scanning period of the input video signal "video."

(Current Setting Type Pixel Circuit)

Figure 13:
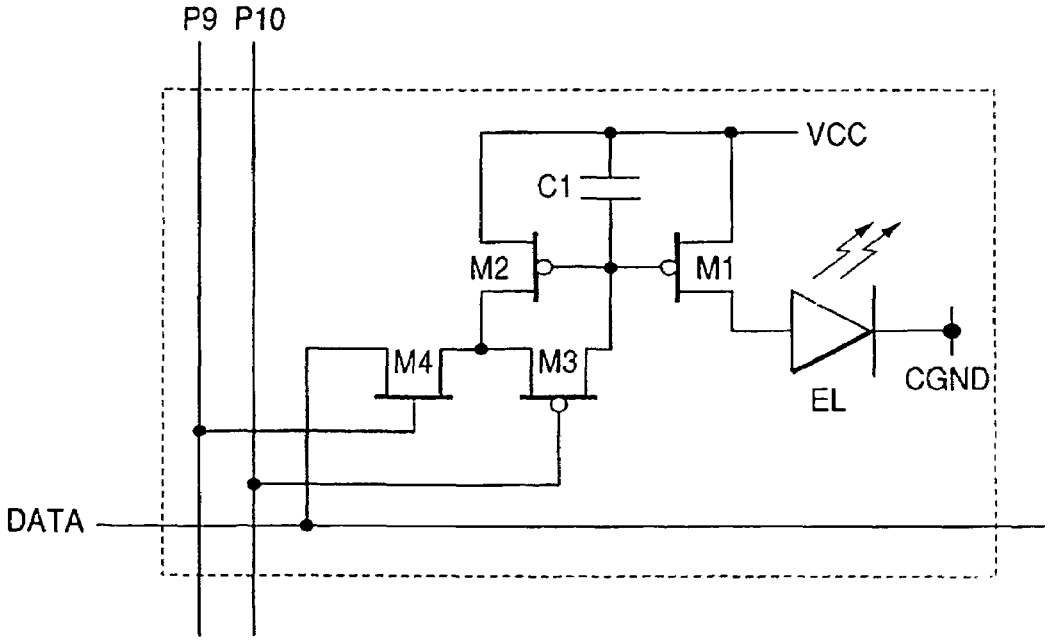
FIG. 13 is a circuit diagram showing another example of the pixel circuit of the current setting type.

FIG. 13 shows an example of the structure of a current setting type pixel circuit 2. P9 and P10 are the row control signals 20, while the current data i(data) is input as the column control signal 14. M1/D is connected to the current injection terminal of a grounded EL element.

Figure 14:
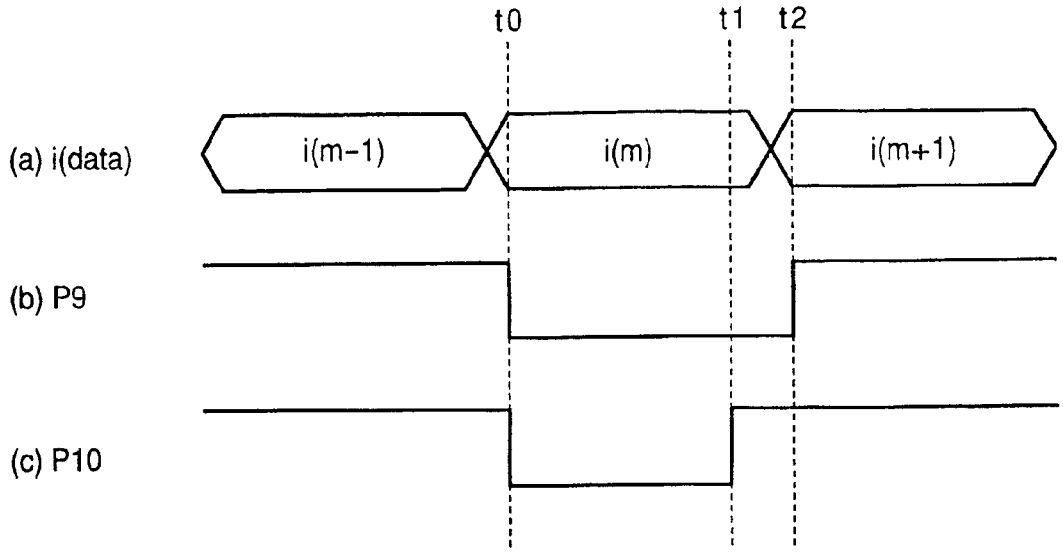
FIG. 14 is a timing chart for explaining the operation of FIG. 13.

The operation of this pixel circuit will be described using a timing chart of FIG. 14. Before time t0, since P9 and P10 in the m-th row are both at H level, M3 and M4 are both OFF-state. Therefore, current is injected into the EL element due to M1/G voltage determined by the charge voltage held in the capacitance C1 and the gate capacitance of M1 to keep the EL element emitting light.

At time t0, both of P9 and P10 in the row concerned change to L level, and current data i(m) in the m-th row is determined. Then, since both of M3 and M4 are turned ON, the current data i(m) is supplied to M2, M2/G voltage is set, and the capacitance C1 and the gate capacitances of M1 and M2 are charged, starting the injection of current corresponding to the current data i(m) into the EL element concerned.

At time t1 at which the current data i(m) has already been determined, P10 changes to H level to turn M3 OFF, so that the setting operation of M2/G voltage is completed, thus moving to the holding operation.

At time t2, P9 also changes to H level to stop the power supply to M2. However, M2/G voltage set by the current data i(m) is held so that continuously re-determined injection current resets the El element concerned to continue emitting light.

Figure 11:
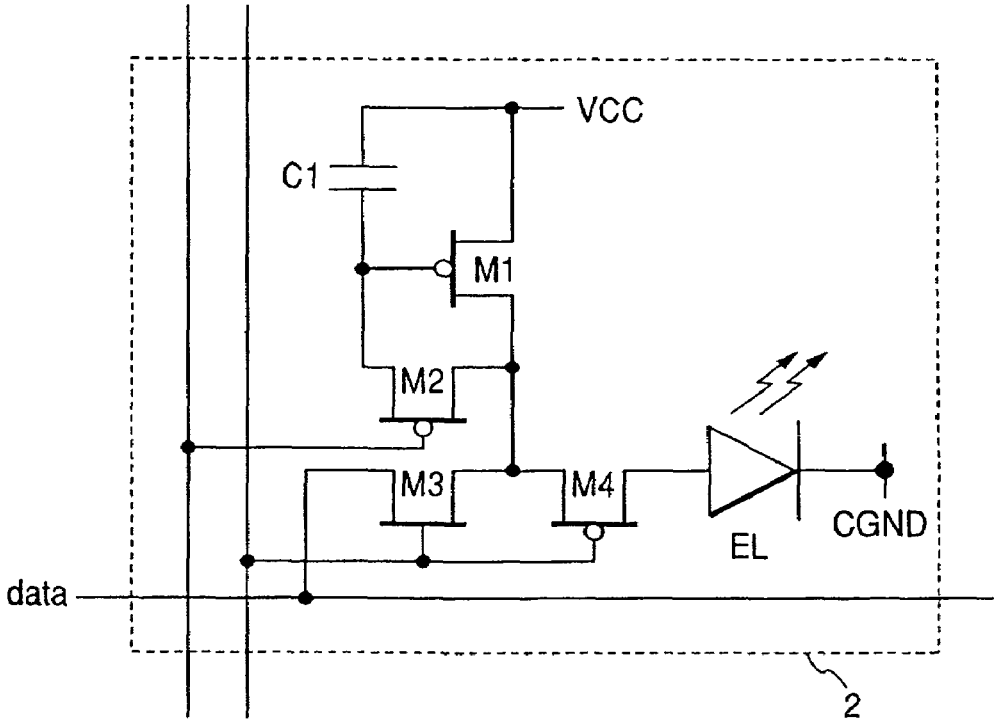
FIG. 11 is a circuit diagram showing an example of a pixel circuit of a current setting type.

FIG. 11 shows another example of the structure of the current setting type pixel circuit 2. P7 and P8 are the row control signals 20, while the current data i(data) is input as the column control signal 14. M4/D is connected to the current injection terminal of a grounded EL element.

Figure 12:
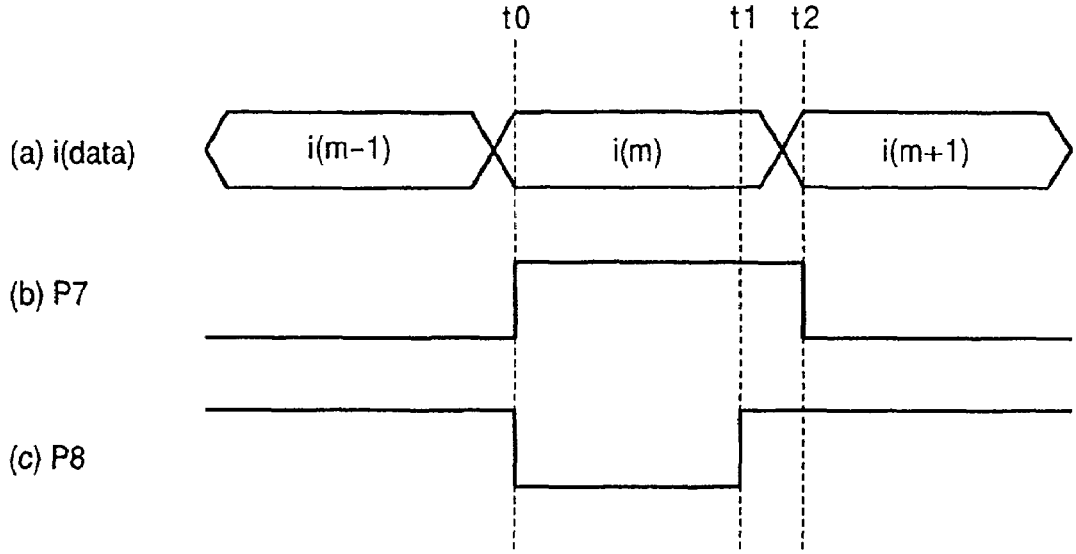
FIG. 12 is a timing chart for explaining the operation of the pixel circuit of FIG. 11.

The operation of this pixel circuit will be described using a timing chart of FIG. 12. Before time t0, since P7 and P8 in the m-th row are at L level and H level, respectively, M2 and M3 are both OFF-state and M4 is ON-state. Therefore, current is injected into the EL element due to M1/G voltage determined by the charge voltage held in the capacitance C1 and the gate capacitance of M1 to keep the EL element emitting light.

At time t0, P7 and P8 in the row concerned change to H level and Level, respectively, and current data i(m) in the m-th row is determined. Then, since both of M2 and M3 are turned ON and M4 is turned OFF to stop the injection of current into the EL element in the row and turn the EL element off. Further, since the current data i(m) is supplied to M2, M2/G voltage is set to charge the capacitance C1 and the gate capacitance of M1.

At time t1 at which the current data i(m) has already been determined, P8 changes again to H level to turn M2 OFF, so that the setting operation of M1/G voltage is completed, thus moving to the holding operation.

At time t2, P7 changes to L level to stop the power supply to M1 and turn M4 ON, so that the drain current of M1 set by M1/G voltage is injected into the EL element concerned. This causes the EL element to start emitting light as reset before time t0.

A video signal processor 152 shown in FIG. 3 performs video signal processing, such as gamma correction, on the video signal "video" applied to the current setting type display panel device or the voltage setting type display panel device, and outputs processed video signal periodically at the horizontal control timing of the display panel device.

Figure 9:
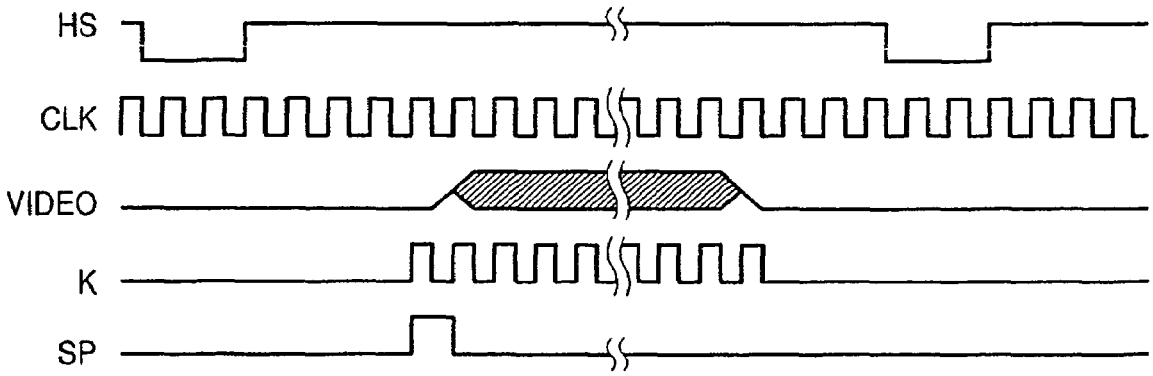
FIG. 9 is a timing chart showing the timings of a horizontal clock and a horizontal scanning start signal.

The video signal "video" is output from the video signal processor as shown in FIG. 9 in synchronization with the horizontal clock signal. In the display panel device, the video signal "video" is sampled and held in the column control circuit as illustrated in FIG. 15 at the timing of the horizontal sampling signal 18 created from the horizontal clock signal and the horizontal scanning start signal. At this time, if the horizontal sampling signal 11 is at "H" level, the sampling operation is performed, while if it is at "L" level, the holding operation is performed.

Figure 22:
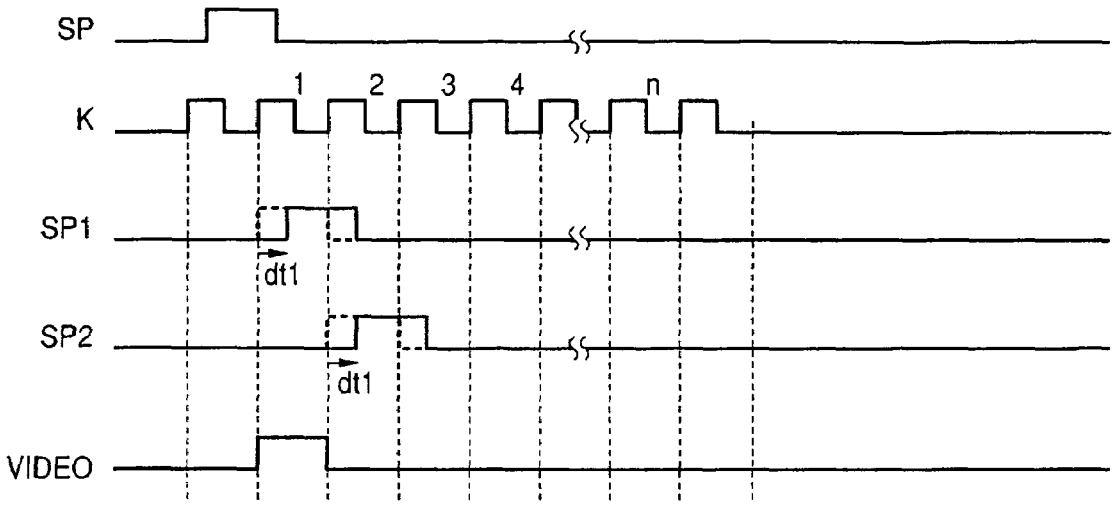
FIG. 22 is a timing chart illustrating the delay of a horizontal sampling signal.

However, since the horizontal sampling signal is created from the horizontal clock signal, a propagation delay occurs in the circuit that crates the horizontal sampling signal. As shown in FIG. 22, if such a delay in the relative timing between the video signal "video" and the horizontal sampling signal occurs improperly, the video signal "video" for a predetermined pixel cannot be exactly sampled and held using the horizontal sampling signal at the predetermined horizontal clock timing. The above describes examples of the voltage setting type display panel device and the current setting type display panel device, and the following describes in detail control of the timing between the sampling signal and the sampled target signal (video signal in this example) as an important feature of the embodiments.

(First Embodiment)

Figure 1:
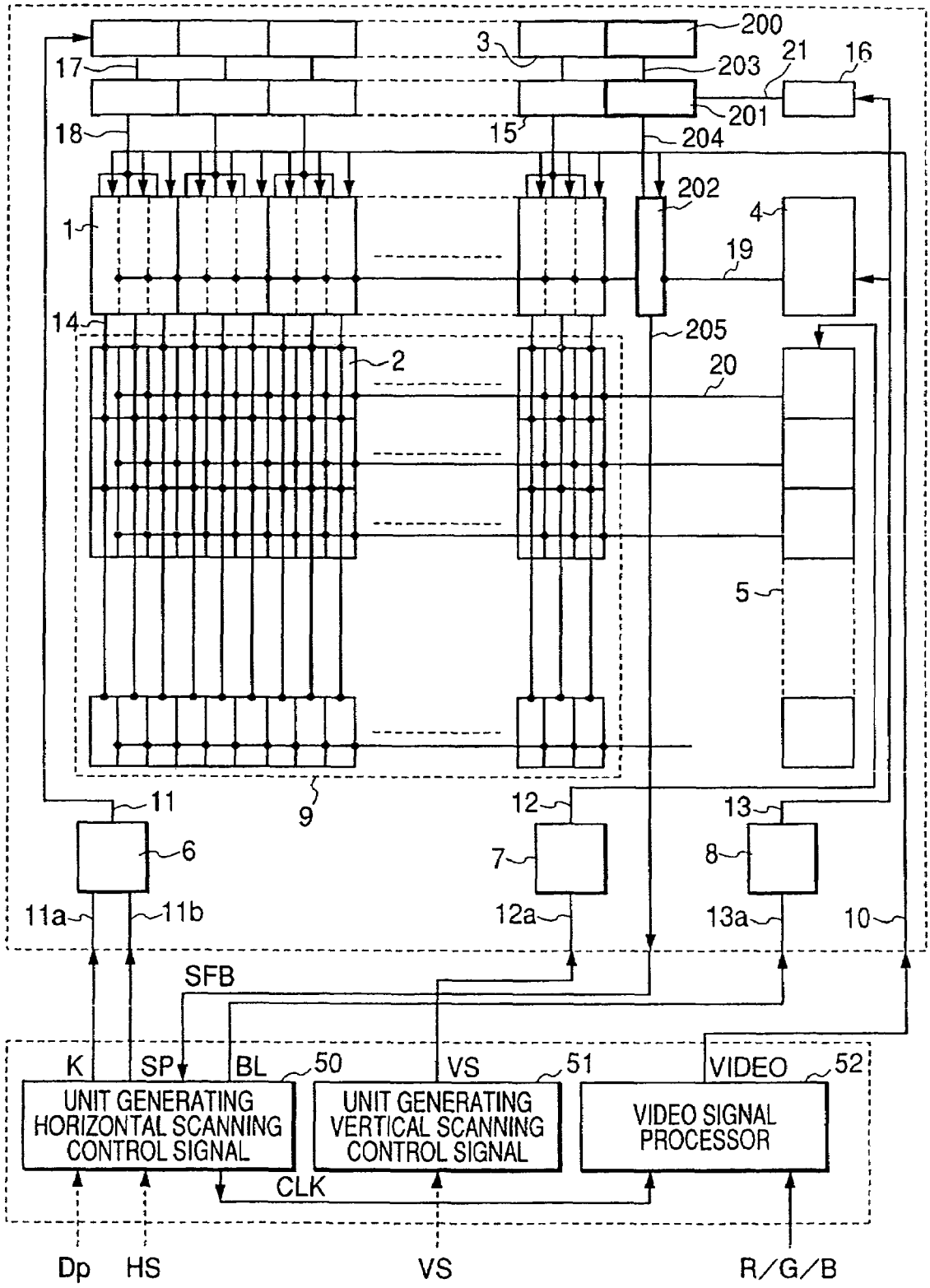
FIG. 1 is a block diagram showing the first embodiment of a display panel device according to the present invention.

FIG. 1 is a block diagram for explaining the first embodiment of the present invention. In the form shown in FIG. 1, the display panel device has such a structure that a horizontal shift register 200 (second sampling signal generating circuit) and a horizontal sampling gate circuit 201, each of which is for one column and has the same circuit structure as the horizontal shift register 3 or horizontal sampling gate circuit 15, are respectively added at the final stages of the horizontal shift registers 3 (first sampling signal generating circuit) and horizontal sampling gate circuits 15 for N columns. Thus the display panel device has the horizontal shift registers (sampling signal generating circuit) for N+1 columns. The horizontal shift registers 3 and 200 are supplied with a horizontal clock signal as a timing signal generated by a unit 50 generating horizontal scanning control signals as a timing signal generating circuit. The horizontal shift registers 3 and 200 generate sampling signals at the timing given by each timing signal. The horizontal sampling signal output of the horizontal sampling gate circuit 201 is coupled to a column control circuit 202 (second sampling circuit) for one column/one color. The structure of the column control circuit 202 is the same as one of the column control circuits 1 (first sampling circuits), and one of the video signals "video" is input into the column control circuit 202. The column control signal output of the column control circuit 202 is not coupled to any pixel circuit; it is output into the timing signal generating circuit as a detection feedback signal SFB. According to the present invention, at least one sampling circuit has only to be connected to the timing signal generating circuit in such a manner as to feedback at least one output to the timing signal generating circuit. In other words, all the sampling circuits do not need to be connected to the timing signal generating circuit. Preferably, as shown in FIG. 1, the display panel device has the sampling signal generating circuit (200) and the sampling circuit (202), not connected to the image display part, to feedback test output to the timing signal generating circuit. In FIG. 1, part 9 surrounded by a dashed line is the image display part that may have the same structure as that of the conventional current setting type EL panel illustrated in FIG. 3. The other parts in the embodiment are also the same as those of the conventional unless otherwise described.

Figure 2:
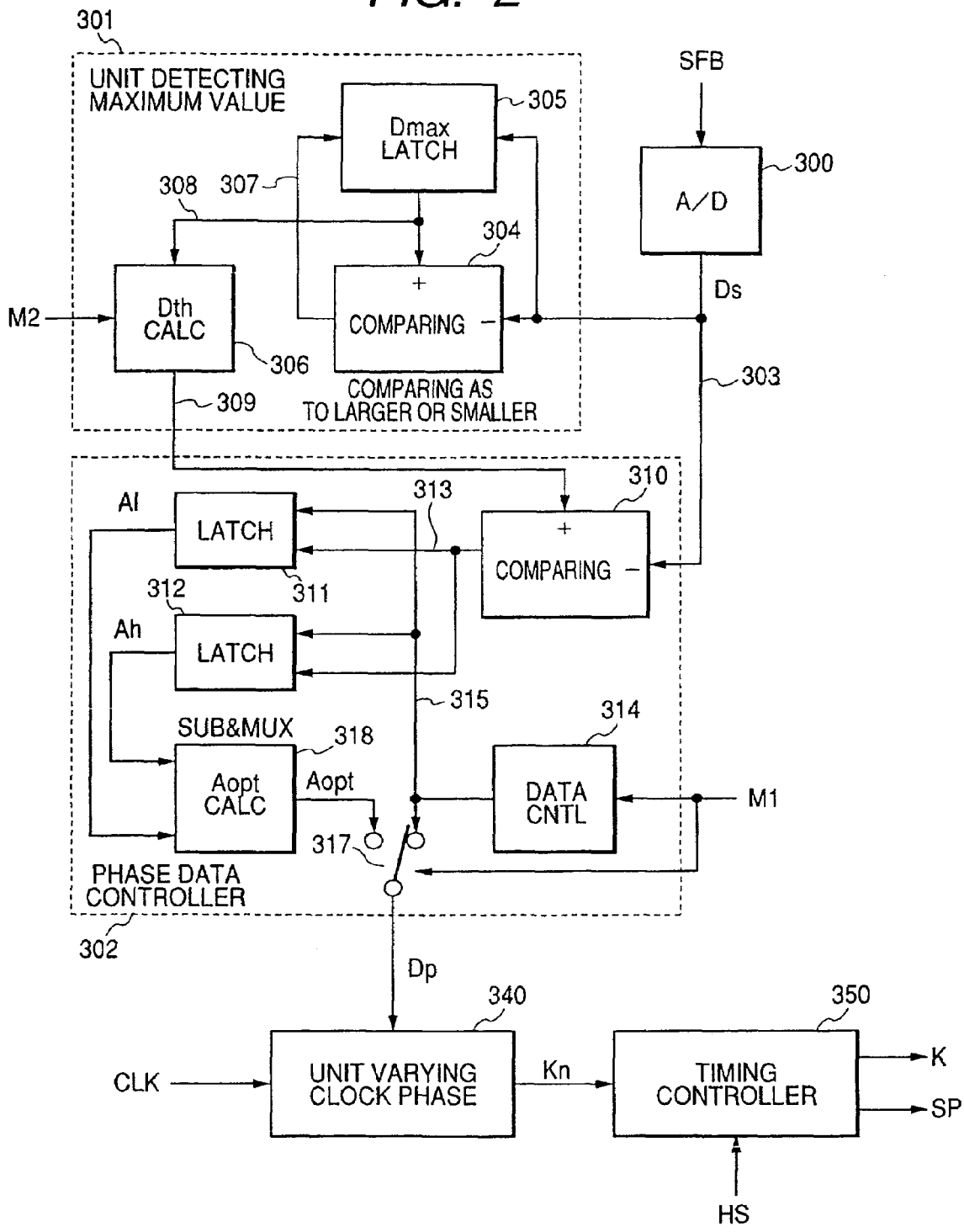
FIG. 2 is a block diagram of a unit generating horizontal scanning control signals used in the display panel device of FIG. 1.

FIG. 2 shows the structure of the unit generating horizontal scanning control signals as the timing signal generating circuit of the present invention.

Figure 4:
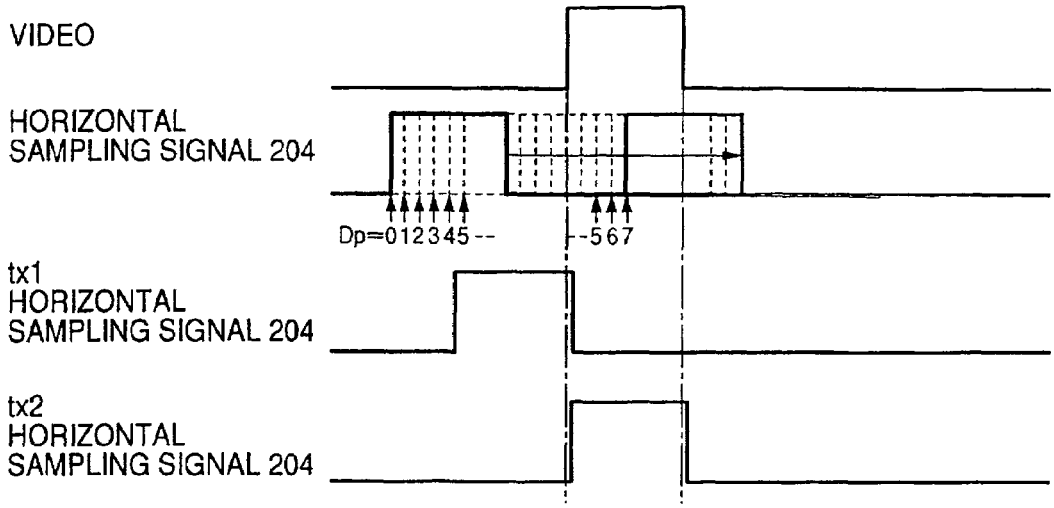
FIG. 4 is a timing chart for explaining the operation of the present invention.

A mode signal M1 is supplied from the outside of the timing signal generating circuit. The display panel device is in a mode to adjust the relative output timing (output phase) between the video signal as the target signal to be sampled and the sampling signal when the mode signal M1 is high, or in any mode (normal driving mode) other than the adjustment mode when the mode signal M1 is low. In FIG. 2, the detection feedback signal SFB (test output) as the output of the column control circuit 202 in the current setting type EL panel part is connected to an A/D converter after converted to a voltage through a register or the like, and converted to digital feedback data Ds. The digital feedback data Ds are coupled to a unit 301 detecting the maximum value and a phase data controller 302. In the phase data controller 302, when the mode signal M1 is H, phase data are consecutively varied in such a manner that the phase of the horizontal clock signal and the phase of the horizontal scanning start signal, each shifting in one direction at a time, become equal to or less than a predetermined shifting width every time the horizontal sync signal HS is input. At this time, plural test target signals are output one by one from a video signal processor 52 as a circuit for outputting target signals. In the embodiment, since the relative output timing between the target signal and the sampling signal is adjusted by adjusting the output timing (output phase) of the sampling signal, the plural test target signals are output at fixed timings (with fixed output phases) because output timing of the sampling signal is adjusted by adjusting the timing of the timing signal for determining the timing of the sampling signal in this embodiment. It is preferable that the test target signal be a rectangle wave as shown in FIG. 4 as a video signal, but it should not be limited to such a rectangle wave. If the test target signal is extremely longer or shorter than the test sampling signal, interrelated peaks of the test target signal and the test sampling signal will become hard to determine. Therefore, it is preferable that the pulse width (half bandwidth) of the test target signal be set equal to or more than one-half times or less than twice the-pulse width (half bandwidth) of the test sampling signal. The test sampling signal may be the same as any sampling signal used at the time of normal driving.

When the mode signal M1 is L, the phase data controller 302 holds and outputs the determined phase data. Phase data output Dp of the phase data controller 302 is coupled to a unit 340 varying clock phases. The unit 340 varying clock phases outputs, to the timing controller 350, a clock signal Kn uniquely determined by the phase data Dp. The timing controller 350 is timed to the horizontal sync signal HS to output the horizontal clock K gated to output the clock signal Kn in a region/interval of a valid video signal so as to output the horizontal scanning start-signal SP at the start timing of the valid video signal.

FIG. 4 shows the relationship between a horizontal sampling signal 204 changed from the phase data and output from the horizontal sampling signal gate circuit 201 in the EL panel part of FIG. 1, and the video signal "video" as the test target signal. The state indicated by a bold line in FIG. 4 is an initial state in which the mode signal M1 has changed from L to H. In this initial state, the rise timing of the horizontal sampling signal 204 is set to progress compared to the fall timing of the video signal "video." At this time, the video signal "video" is a pulsed signal with its width corresponding to one cycle of the horizontal clock signal K. In this case, it is desirable that the H level should be set to as large a level as possible in order to convert to voltage the detection feedback signal SFB as the output of the column control circuit 202 and avoid improper influence such as noise. Further, in order to increase the dynamic range of the output of the column control circuit 202, the L level should be set so that the output of the column control circuit 202 will become zero.

In the embodiment, the phase of the horizontal clock signal K and the phase of the horizontal scanning start signal SP are varied so that they will shift in a direction to delay the phases by one-eighth of a horizontal clock signal cycle To each time the phase data is counted up. Consequently, the phase of the horizontal sampling signal 204 is delayed by one-eighth of To with respect to the video signal "video" each time the phase data is varied. The phase stepping operation based on the phase data is continued until the falling edge of the horizontal sampling signal 204, that is, the completion timing of sampling is completely delayed from the fall timing of the video signal "video." In the embodiment, although a description will be made of a case where the phase is varied during the period of two To cycles, the effect of optimization of timing according to the present invention can be obtained provided that the phase stepping period is set at least equal to or longer than one sampling pulse width. In other words, this phase stepping period needs to sufficiently cover a period in which errors in phase relation between the video signal "video" and the horizontal sampling signal 204 are actually expected, but it does not means that the phase stepping period is limited to the period of two To cycles.

The operation of the display panel device of the embodiment will be described using a timing chart of FIG. 5.

Figure 5:
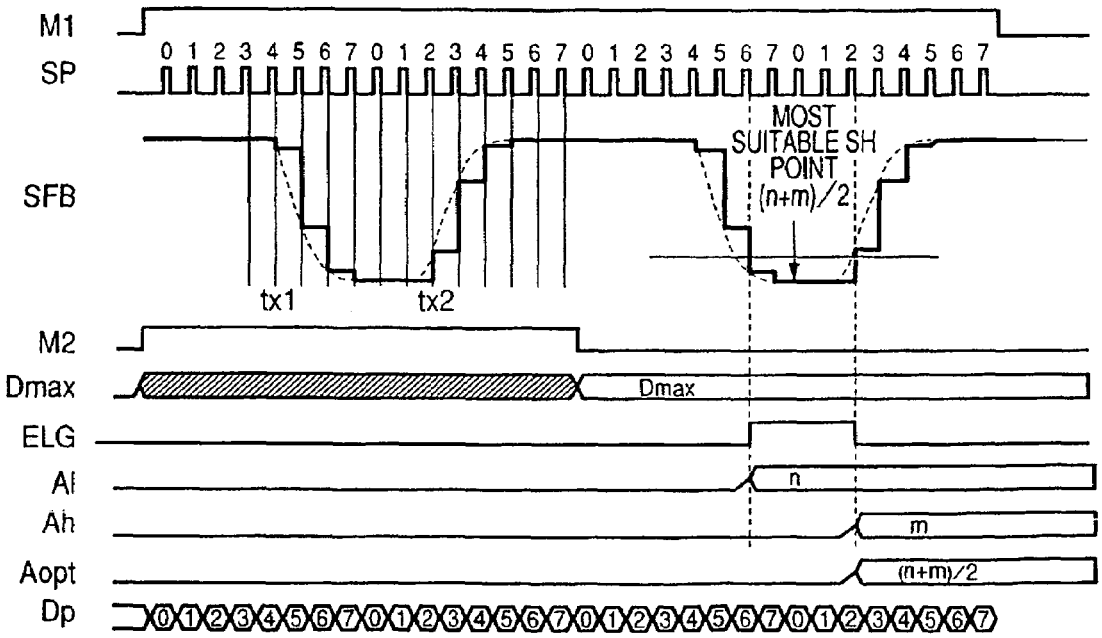
FIG. 5 is a timing chart for explaining the first embodiment of the present invention.

In FIG. 5, when the mode signal M1 becomes H, the phase data Dp output from a phase data output circuit 314 varies in the range between 0 and 7 at any timing (for example, it may be the input timing of the horizontal sync signal). The phase data thus varying in the above manner causes the horizontal clock signal K and the horizontal scanning start signal SP to shift their phases by Δone-eight of the horizontal clock signal period To as described with respect to FIG. 4. Then, the relationship between the fall timing of the video signal "video" and the fall timing of the horizontal sampling signal 204 causes the detection feedback signal SFB to vary as shown in FIG. 5. The relationship between the video signal "video" and the horizontal sampling signal 204 at timings tx1 and tx2 in FIG. 5 is shown in FIG. 4 as timing charts of tx1 and tx2, respectively.

Before time tx1, the H interval of the horizontal sampling signal 204 dose not overlap with the H interval of the video signal "video." In this case, since the video signal cannot be sampled by the sampling operation, the detection feedback signal is "0." At time tx1, overlap between the H interval of the horizontal sampling signal 204 and the H interval of the video signal "video" occurs. In this case, the video signal is sampled, but since the overlapping period is shorter than the required sampling time, the sampling cannot be completed. Then, as the phase of the horizontal clock signal starts delaying, the overlapping period between the H interval of the horizontal sampling signal 204 and the H interval of the video signal "video" becomes longer, and when the overlapping period becomes equal to or longer than the time enough for sampling, the H level of the video signal can be sampled normally.

As the phase of the horizontal clock signal is further delayed, the fall timing of the horizontal sampling signal 204 becomes delayed with respect to the fall timing of the video signal at time tx2. Under this condition, although the H level of the video signal "video" is sampled from the rise timing of the horizontal sampling signal 204 until the fall timing of the video signal "video," the L level of the video signal "video" is sampled from the fall timing of the video signal until the fall timing of the horizontal sampling signal 204 (tx2) As a result, the H level of the video signal "video" cannot be sampled normally. A comparison between the time to sample the H level of the video signal "video" and the time to sample the L level shows that the time to sample the L level of the video signal "video" increases after time tx2, and hence the detection feedback signal SFB approaches to 0 level.

Further, in FIG. 5, when the mode signal M2 is H, the unit 301 detecting the maximum value of FIG. 2 detects the maximum value. Then, when M2=L, the unit 301 detecting the maximum value holds the maximum value detected at the time of M2=H. The maximum value detected by the unit 301 detecting the maximum value denotes the maximum value of changes in the video signal "video" at the time of H level detection from the results of 0 level sampling of the video signal "video" based on the detection feedback signal. It is independent of the direction of sink/source current in the current driving system of the current driving EL panel, and the positive and negative direction of voltage changes upon conversion of the current to voltage.

In FIG. 5, the mode signals M1 and M2 first go to H to enter a sampling timing detection mode and a maximum value detection mode for detecting the maximum value of the detection feedback signal. As mentioned above, the phase of the horizontal clock signal and the phase of the horizontal scanning start signal SP are varied to scan the phase relationship 360 degrees or more between the video signal "video" and the horizontal sampling signal 204 so as to change the level of the detection feedback signal SFB. The detection feedback signal SFB is A/D-converted, and then converted to digital feedback data Ds. The digital feedback data Ds is coupled to a latch circuit 305 and a comparator 304. When the mode signal M2 goes to H to enter the maximum detection mode, the latch circuit 305 is reset to "0." Then, when digital feedback data Ds larger than the output of the latch circuit is input into the comparator 304, the latch circuit updates the digital feedback data and outputs the maximum value of the digital feedback data as the output of the latch circuit. A threshold calculating unit 306 calculates a threshold from the maximum data as the output of the latch circuit, provided that sampling has been done normally. The threshold is set as a multiplication factor to the maximum value such as X percent, or in such a manner as to add an offset such as −X.

After completion of detection of the maximum value, when the mode signal M2 is set to L, the phase data is counted up again from 0 in the same manner as in the maximum value detecting operation to reproduce the same detection signal as the detection feedback signal SFB. At this time, the unit 301 detecting the maximum value does not detect the maximum value, and the threshold calculating unit 306 outputs the calculated threshold data 310 to a comparator in the phase data controller 302. The other input of the comparator 310 is coupled to the A/D-converted digital feedback data Ds so that the threshold data and the digital feedback data will be compared according to phase changes in the horizontal clock signal. In other words, after completion of detection of the maximum value, when the phase of the horizontal clock signal is first set to the initial state, the comparison between the phase of the horizontal clock signal and the phase of the video signal "video" shows that the level of the detection feedback signal as the sampling result is "0," indicating (digital feedback data)< (threshold data). Then, as the phase of the horizontal clock signal K is delayed, the digital feedback data Ds increases. A latch unit 311 stores the phase data Dp that first indicated (digital feedback data)>(threshold data) as first phase data Al in a sampling correct range. After the latch unit 311 has stored the phase data Al, a latch unit 312 stores the phase data Dp that indicated (digital feedback data)<(threshold data) again as last phase data Ah in the sampling correct range. An arithmetical operation unit 318 performs an arithmetical operation for determining the optimum position of the horizontal clock signal from the phase data Al and Ah indicating the beginning and ending of the correct sampling range, and outputs optimum phase data Aopt. This embodiment shows an example in which the optimum data Aopt is set as Aopt=(Al+Ah)/2 on the condition that the optimum phase of the horizontal clock signal K is a median in the correct sampling range, the setting of Aopt is not limited to the above case, and it can be set freely:

(1) by adding a positive offset to Al data, (2) by adding a negative offset to Ah data, or (3) as (Al+Ah) * M (where M is a positive real number).

When the optimum value detecting sequence is completed in the phase data controller 302, the mode signal M1 is set to L, SW317 is switched so that the optimum phase data Aopt can be output to the unit 340 varying clock phases. The unit 340 varying clock phases and the timing controller 350 have the structure as previously described with respect to FIG. 8; they output a horizontal clock signal the phase of which makes it possible to sample the video signal "video" optimally in the EL panel part using the horizontal sampling signal.

As described above and according to the present invention, multiple timing signals obtained and output by varying the phase data consecutively in such a manner that one shift in one direction will be equal to or less than the predetermined shifting width within a predetermined phase stepping period are used as test timing signals, so that adjustments are made based on multiple sampling results obtained by sampling multiple test video signals, thereby optimizing the output timing of driving timing signals.

The operation for optimizing the timing of sampling is performed by varying the phase of horizontal clock signal relative to the video signal "video" to change sampling operation modes on purpose in a sequence of improper timing of sampling operation, normal timing, and improper timing. Since the sampling operation includes the improper operation mode, it is desirable that the operation for optimizing the timing of sampling should be performed at the time of a non-signal, such as upon activation (at power-on), during standby, or a vertical scanning blanking period. The time of power-on means a transition from such a state that no image is displayed due to a partial or complete interruption of the power supply to be used for image display to such a state that the power required for image display is supplied. Further, the standby time means a time period during which partial power supply to be used for image display is suspending.

In the embodiment, the above describes about the current setting type EL panel, but the present invention can also be applied to any other display panel device. In the case of a voltage setting type or a liquid crystal panel for displaying images by voltage-sampling video signals, the output of sampling means can be fed back to timing signal generating means through buffer means, thus enabling the implementation of the present invention in the same manner as in the above-mentioned embodiment.

In FIG. 1, the horizontal clock signal is the timing signal. Therefore, important circuits in the embodiment are the timing signal generating circuit for generating timing signals, the sampling signal generating circuits as illustrated in the form of a horizontal shift register, and the sampling circuit illustrated as one of the column control circuits of which at least one is connected to the timing signal generating circuit. The timing signal generating circuit determines the output timing of the driving timing signal based on the test output fed back from the column control circuit as the sampling circuit.

(Second Embodiment)

This embodiment has the same structure as the first embodiment except for the unit generating horizontal scanning control signals. Therefore, the following describes the structure and operation of the different portions.

Figure 6:
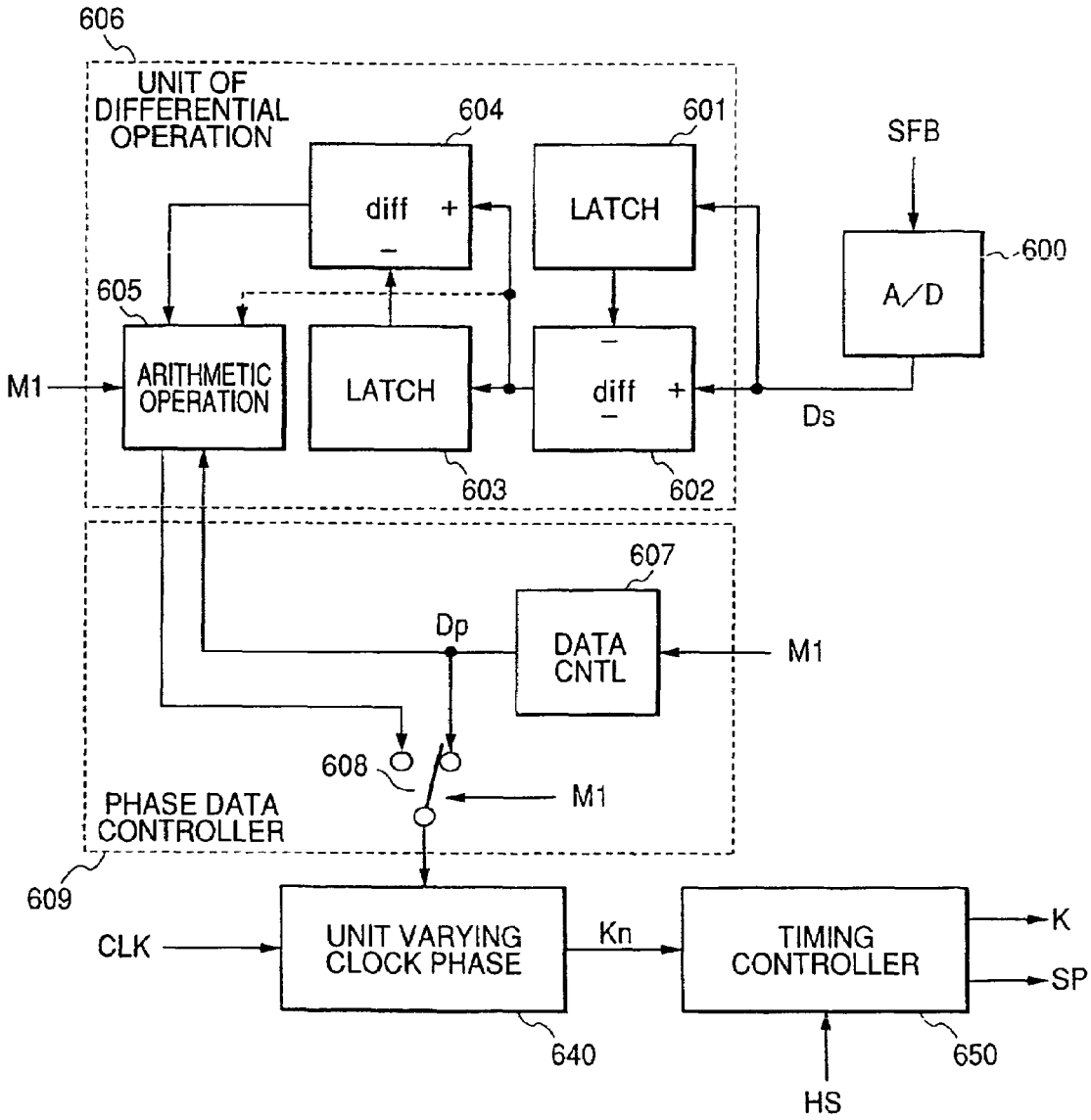
FIG. 6 is a block diagram of a unit generating horizontal scanning control signals used in the second embodiment of the present invention.

FIG. 6 is a block diagram of a unit generating horizontal scanning control signals used in the second embodiment of the present invention. Like in the first embodiment, the second embodiment is such that the phase of the horizontal clock signal as the timing signal and the phase of the horizontal scanning start signal SP are varied with respect to the phase of the test video signal "video," and the output of the column control circuit as the sampling circuit is fed back to the timing signal generating means as the detection feedback signal (test output). In the second embodiment, the optimum sampling timing is detected based on the differential value of variation in level of the detection feedback signal relative to the variation in phase of the horizontal clock signal to determine the phase of the horizontal clock signal and the phase of the horizontal scanning start signal.

In FIG. 6, the detection feedback signal input into the unit generating horizontal scanning control signals is converted by an A/D converter 600 to digital feedback data Ds. The digital feedback data Ds is coupled to a latch unit 601 and a subtracter 602. The latch unit 601 latches the digital feedback data Ds every time the phase of the horizontal clock signal is varied. The output diff1 of the subtracter 602 is coupled to a latch unit 603 and a subtracter 604. After the subtracter 602 performs an arithmetical operation on the latch result from the latch unit 601, the latch unit 603 latches the output of the subtracter 602 in response to a proper timing signal the timing of which allows enough room for the timing of varying the phase of the next horizontal clock signal. The output of the latch unit 603 is coupled to the subtracter 604, and the output diff2 of the subtracter 604 becomes the result of the second-order differentiation (difference) of the detection feedback signal.

The output diff2 of the subtracter 604 and the phase data Dp of a phase data controller 609 are input into an arithmetical operation unit 605. The arithmetical operation unit 605 outputs optimum phase rotation data Aopt to SW 608. After completion of the operation for optimizing the sampling timing, the SW 608 selects the optimum phase data in response to the mode signal M1, and outputs the optimum phase rotation data to the unit varying clock phases. Then, the phase of the horizontal clock signal and the phase of the horizontal scanning start signal are determined so that the video signal "video" can be optimally sampled in the EL panel part using the horizontal sampling signal.

As shown by a doted line in FIG. 6, the output diff1 of the subtracter 602 can be coupled to the arithmetical operation unit 605 instead of the output diff2 of the subtracter 604. In this case, the subtracter 604 and the latch unit 603 do not need providing.

The operation of the display panel device of the embodiment will be described using a timing chart of FIG. 7.

First, the mode signal M1 goes to H to start the operation for optimizing the timing of sampling. Like in the first embodiment, the phase data Dp output from a phase data output circuit 607 is varied to vary the phase of the horizontal clock signal and the phase of the horizontal scanning start signal SP. Then, the video signal "video" on the pulses for the horizontal clock signal cycle To is scanned at the fall timing of the horizontal sampling signal 204. In FIG. 7, SFBdiff1 is the representation of the first-order differentiation of the detection feedback signal SFB, and SFBdiff2 is the representation of the second-order differentiation of SFB. In the embodiment, since the detection feedback signal SFB is converted by the A/D converter 600 to the digital feedback data Ds, the output of the subtracter 602 corresponds to SFBdiff1 and the output of the subtracter 604 corresponds to SFBdiff2.

The following describes a method of determining the optimum phase data in the arithmetical operation unit 605.

(A) In the case of use of the output diff2 of the subtracter 604

Figure 7:
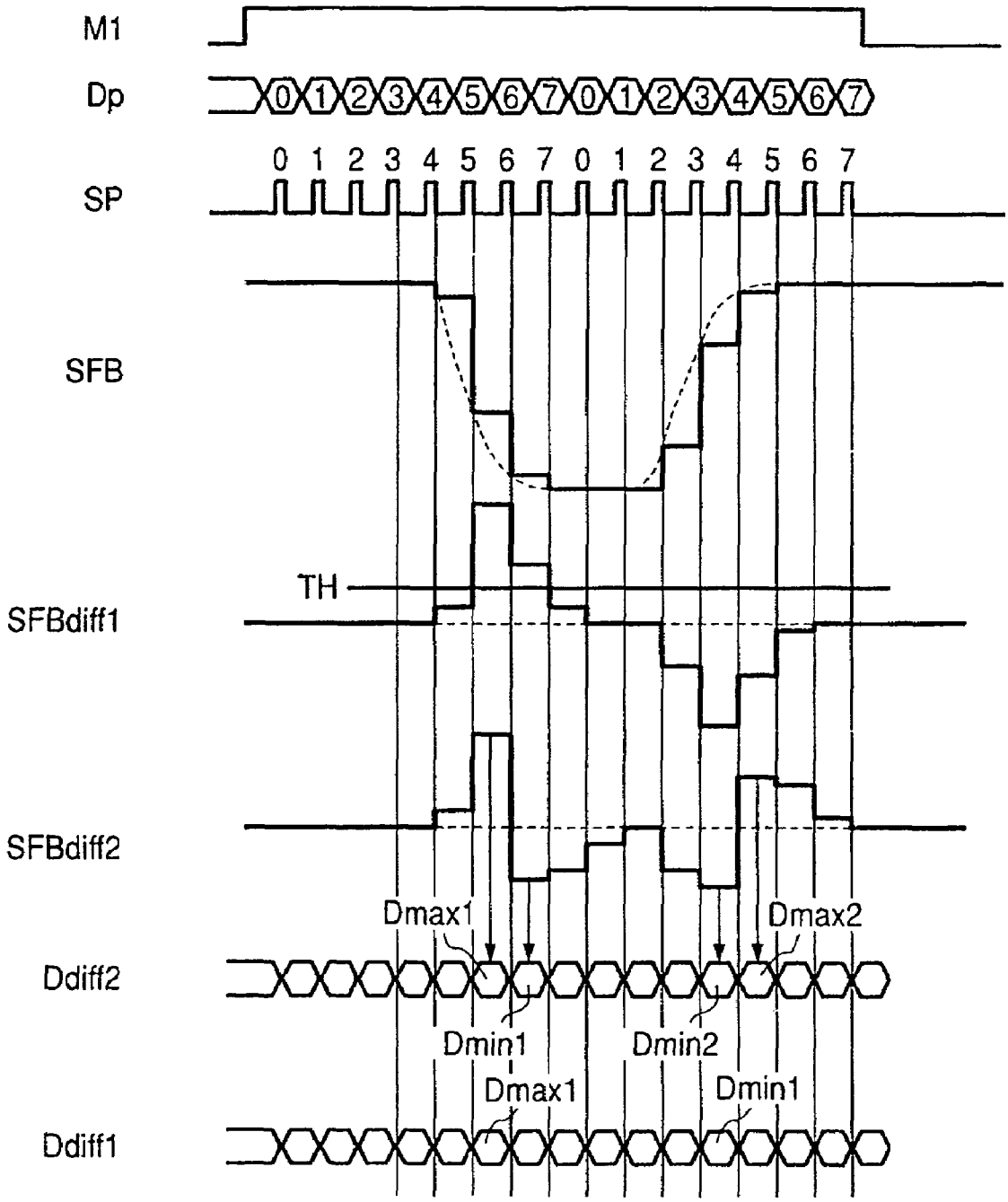
FIG. 7 is a timing chart for explaining the second embodiment of the present invention.

As shown in FIG. 7, each output of the subtracter 604 is represented as follows: the phase data at time Dmax1 for the first positive maximum value is Dpmax1, the phase data at time Dmin1 for the first negative maximum value is Dpmin1, the phase data at time Dmax2 for the second positive maximum value is Dpmax2, the phase data at time Dmin2 for the second negative maximum value is Dpmin2, and the optimum phase data is Aopt.

Method 1) Aopt=(Dpmax1+Dpmin1)/2+Dpmin1

Method 2) Aopt=(Dpmin1+Dpmin2)/ 2

Method 3) Aopt=Dpmin1

B) In the case of use of the output diff1 of the subtracter 602

As shown in FIG. 7, each output of the subtracter 602 is represented as follows: the phase data at time Dmax1 for the first positive maximum value is Dpmax1, the phase data at time Dmin1 for the first negative maximum value is Dpmin1, and the optimum phase data is Aopt. Further, when diff1 fall below preset threshold data Dth after detection of Dmax1, the phase data is represented as Dpx.

Method 1) Aopt=(Dpmax1+Dpmin1)/2

Method 2) Aopt=Dpx

Method 3) Aopt=Dpx+Dy (where Dy is fixed value data)

The second embodiment aims at focusing attention on the amount of variation according to the sampling state of the detection feedback signal and the direction of variation. Therefore, the present invention is not limited to the above-mentioned arithmetic methods.

What is claimed is:

1. A display device for displaying images based on video signals, comprising:

a timing signal generating circuit for generating a timing signal;

a sampling signal generating circuit for generating a sampling signal at the timing corresponding to the timing signal; and a sampling circuit for sampling a target signal during a sampling period set by the sampling signal and outputting the sampled target signal, wherein said sampling circuit is connected to said timing signal generating circuit so that test output obtained by sampling a test target signal during the sampling period set by the sampling signal corresponding to a test timing signal generated by said timing signal generating circuit can be input into said timing signal generating circuit, and said timing signal generating circuit controls the relative output timing between the timing signal and the target signal under the control based on the test output input.

2. A display device according to claim 1, wherein the relative output timing between the timing signal and the target signal is controlled based on the maximum value of test outputs corresponding to multiple test timing signals having different output timings.

3. A display device according to claim 1, wherein the relative output timing between the timing signal and the target signal is controlled based on the differential value of test outputs corresponding to multiple test timing signals having different output timings.

4. A display device according to claim 1, wherein the relative output timing between the timing signal and the target signal is controlled based on the second-order differential value of test outputs corresponding to multiple test timing signals having different output timings.

5. A display device according to claim 1, wherein the test timing signal is generated from said timing signal generating circuit during a period for which no video signal is programmed in pixels that form an image display part for displaying images to determine the relative output timing between the timing signal and the target signal.

6. A display device according to claim 1, wherein the test timing signal is generated from said timing signal generating circuit during a power-on or standby time or a vertical blanking period to determine the relative output timing between the timing signal and the target signal.

7. A display device according to claim 1, wherein the test timing signal is generated from said timing signal generating circuit during a vertical blanking period to determine the relative output timing between the timing signal and the target signal.

8. A display device according to claim 1, wherein the output of said sampling circuit is a current signal.

9. A display device according to claim 1, wherein the output of said sampling circuit is a voltage signal, and the relative output timing between the timing signal and the target signal is determined based on test output of said sampling circuit through a level converting circuit.

10. A signal generating circuit comprising:

a timing signal generating circuit for generating a timing signal by which the timing of generating a sampling signal is determined;

a target signal output circuit for outputting a target signal to be sampled; and an adjustment circuit for adjusting the relative output timing between the timing signal and the target signal, wherein said adjustment circuit adjusts the relative output timing between the timing signal and the target signal based on plural sampling results obtained from plural states in each of which the relative output timing between a test timing signal and a test target signal is made different from those in the other states.

11. A display panel, comprising:

a plurality of display elements;

a plurality of first sampling signal generating circuits which sequentially generate a plurality of first sampling signals for sequentially sampling a target signal;

a plurality of first sampling circuits for sequentially sampling a target signal during the sampling periods set by the first sampling signals;

a plurality of wires between the output of said first sampling circuits and said display elements;

a second sampling signal generating circuit which generates a second sampling signal for sampling a target signal;

a second sampling circuit for sampling a target signal during a sampling period set by said second sampling signal; and a wire for outputting the output of said second sampling circuit to external of said display panel without passing through the display elements.

* * * * *

UNITED STATES PATENT AND TRADEMARK OFFICE

CERTIFICATE OF CORRECTION

PATENT NO. : 7,242,397 B2
APPLICATION NO. : 10/847855
DATED : July 10, 2007
INVENTOR(S) : Masami Iseki et al.

It is certified that error appears in the above-identified patent and that said Letters Patent is hereby corrected as shown below:

COLUMN 3:

Line 42, “FIG. 7D” should read --FIG. 17D--.

COLUMN 4:

Line 54, “signal” should read --signals--.

COLUMN 5:

Line 15, “are input” should read --is input--.
Line 32, “handle” should read --handler--.

COLUMN 6:

Line 10, “El element” should read --EL element--.

COLUMN 7:

Line 52, “signial” should read --signal--.

COLUMN 10:

Line 44, “Level,” should read --L level,--.

COLUMN 11:

Line 11, “crates” should read --creates--.

COLUMN 12:

Line 54, “start-signal” should read --start signal--.

COLUMN 13:

Line 46, “dose not” should read --does not--.

UNITED STATES PATENT AND TRADEMARK OFFICE

CERTIFICATE OF CORRECTION

PATENT NO. : 7,242,397 B2
APPLICATION NO. : 10/847855
DATED : July 10, 2007
INVENTOR(S) : Masami Iseki et al.

It is certified that error appears in the above-identified patent and that said Letters Patent is hereby corrected as shown below:

COLUMN 14:

Line 3, "(tx2) As" should read --(tx2). As--.

COLUMN 16:

Line 51, "doted line" should read --dotted line--.

Signed and Sealed this

Third Day of February, 2009

John Doll

JOHN DOLL
*Acting Director of the United States Patent and Trademark Office*